US008714728B2

(12) United States Patent
Chiwata

(10) Patent No.: US 8,714,728 B2
(45) Date of Patent: May 6, 2014

(54) INKJET RECORDING METHOD

(71) Applicant: FUJIFILM Corporation, Tokyo (JP)

(72) Inventor: Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/747,181

(22) Filed: Jan. 22, 2013

(65) Prior Publication Data

US 2013/0222500 A1 Aug. 29, 2013

(30) Foreign Application Priority Data

Feb. 24, 2012 (JP) ..... 2012-039231

(51) Int. Cl.
*B41M 7/00* (2006.01)
*B41J 11/00* (2006.01)

(52) U.S. Cl.
CPC ..... *B41M 7/0081* (2013.01); *B41J 11/0015* (2013.01); *B41J 11/002* (2013.01)
USPC ..... 347/102

(58) Field of Classification Search
CPC ..... B41M 7/0081; B41J 11/0015
USPC ..... 347/102
See application file for complete search history.

(56) References Cited

U.S. PATENT DOCUMENTS 8,157,370 B2 * 4/2012 Irita ..... 347/105
8,337,953 B2 * 12/2012 Nakazawa et al. ..... 427/261
8,414,118 B2 * 4/2013 Makuta et al. ..... 347/104
2009/0231377 A1 9/2009 Kachi
2009/0233061 A1 * 9/2009 Irita ..... 428/195.1
2011/0057983 A1 3/2011 Kato et al.
2011/0057985 A1 3/2011 Kakino et al.
2011/0227991 A1 * 9/2011 Sasada et al. ..... 347/20
2013/0016156 A1 1/2013 Ooishi et al.

FOREIGN PATENT DOCUMENTS

JP 2004-034543 A 2/2004
JP 2004-090303 A 3/2004
JP 2004-291415 A 10/2004
JP 2007-160839 A 6/2007
JP 2009-83439 A 4/2009

(Continued)

OTHER PUBLICATIONS

The extended European Search Report issued on May 27, 2013, which corresponds to EP Application No. 13152842.4-1701 and is related to U.S. Appl. No. 13/747,181.

(Continued)

*Primary Examiner* — Huan Tran
(74) *Attorney, Agent, or Firm* — Studebaker & Brackett PC

(57) ABSTRACT

An inkjet recording method comprising a jetting step using a paper sheet, wherein a decay rate of ultrasonic transmittance through the paper sheet after five seconds with respect to ultrasonic transmittance through the paper sheet immediately after immersion of the paper sheet in pure water is from 4% to 26%, and jetting aqueous ultraviolet-curable ink onto a front surface of the paper sheet with an inkjet recording head; a conveyance step of conveying the paper sheet to an exposure section such that an amount of time from the jetting step until exposing the aqueous ultraviolet-curable ink on the paper sheet to ultraviolet light is from 1 second to 8 seconds; and an exposure step of exposing the aqueous ultraviolet-curable ink on the paper sheet to ultraviolet light to thereby cure the aqueous ultraviolet-curable ink.

7 Claims, 5 Drawing Sheets

(56) References Cited

FOREIGN PATENT DOCUMENTS

| | | | |
|---|---|---|---|
| JP | 2009-91528 | A | 4/2009 |
| JP | 2009-220954 | A | 10/2009 |
| JP | 2011-57791 | A | 3/2011 |
| JP | 2011-57830 | A | 3/2011 |
| JP | 2011-208093 | A | 10/2011 |
| JP | 2012-12443 | A | 1/2012 |
| WO | 2011/122356 | A1 | 10/2011 |

OTHER PUBLICATIONS

An Office Action; "Notice of Reasons for Rejection," issued by the Japanese Patent Office on Dec. 17, 2013, which corresponds to Japanese Patent Application No. 2012-039231 and is related to U.S. Appl. No. 13/747,181; with partial translation.

* cited by examiner

FIG.8

| BRAND | MANUFACTURER | ULTRASONIC DECAY RATE (%) 5 SECONDS AFTER IMMERSION IN WATER | AMOUNT OF TIME FROM DRAWING TO UV IRRADIATION | | | | | |
|---|---|---|---|---|---|---|---|---|
| | | | 0.5sec | 1sec | 2sec | 6sec | 8sec | 10sec |
| TOKUBISHI ART | MITSUBISHI PAPER MILLS LIMITED | 2.55 | Good/Poor | Good/Poor | Good/Poor | Good/Poor | Fair/Poor | Fair/Good |
| OK TOPCOAT+ | OJI PAPER CO.,LTD. | 4.02 | Good/Poor | Good/Fair | Good/Fair | Good/Fair | Fair/Fair | Fair/Good |
| PEARL COAT N | MITSUBISHI PAPER MILLS LIMITED | 7.32 | Fair/Poor | Good/Fair | Good/Good | Good/Good | Fair/Good | Poor/Good |
| DELTA SOFT | HOKUETSU PAPER CO.,LTD. | 15.07 | Fair/Poor | Good/Fair | Good/Good | Good/Good | Fair/Good | Poor/Good |
| U-LIGHT | NIPPON PAPER GROUP, INC. | 26.75 | Fair/Poor | Fair/Fair | Fair/Fair | Fair/Good | Fair/Good | Poor/Good |
| OK PRINCE HIGH-QUALITY | OJI PAPER CO.,LTD. | 76.02 | Poor/Poor | Poor/Fair | Poor/Good | Poor/Good | Poor/Good | Poor/Good |

EVALUATION POINTS CURLING / ADHESION

INKJET RECORDING METHOD

CROSS-REFERENCE TO RELATED APPLICATION

This application claims priority under 35 USC 119 from Japanese Patent Application No. 2012-039231 filed on Feb. 24, 2012, the disclosure of which is incorporated by reference herein.

BACKGROUND OF THE INVENTION

1. Technical Field

The present invention relates to an inkjet recording method.

2. Related Art

In Japanese Patent Application Laid-Open (JP-A) No. 2004-34543, there is disclosed a method of regulating, to a fixed temperature, the temperature of a medium at the time of ultraviolet (UV) exposure. This promotes an ink polymerization reaction resulting from the UV exposure and suppresses curling from occurrence because of an excessive rise in the temperature of the medium.

In JP-A No. 2004-90303, there is disclosed a method of controlling UV curing and medium deformation by regulating, by air blowing, humidity in a position where a recording medium is subjected to ultraviolet irradiation and the neighborhood of this position.

In JP-A No. 2007-160839, there is disclosed an inkjet recording method that uses ink containing, from 30% by mass to less than 90% by mass of the total ink mass, a water-soluble organic solvent with a SP value (hydrophilicity) of from 16.5 to less than 24.6. This method suppresses the occurrence of curling of the medium by administering forced drying of the paper surface 0 seconds to 3 seconds after the ink has landed.

SUMMARY

Ultraviolet-curable ink (UV ink) is generally non-aqueous, and in UV-curing inkjet recording methods using this UV ink, a temperature and humidity of a paper sheet at the time of UV exposure affect the curing reaction. Further, the temperature and humidity of the paper sheet also affect the curling of the paper sheet. For this reason, the methods described in JP-A 2004-34543 and JP-A No. 2004-90303 control the temperature and humidity of the paper sheet, but there is room for improvement in order to apply these methods to aqueous ultraviolet-curable ink (aqueous UV ink).

That is, with aqueous UV ink, a water balance in the paper sheet becomes imbalanced and curling occurs because of penetration of the ink into the paper sheet and volatility of a water thereafter. Further, depending on the state of the penetration of the ink into the paper sheet, this also affects the strength of the ink after UV exposure. Techniques for controlling these are not described in the aforementioned patent documents.

In consideration of the above circumstances, the present invention provides an inkjet recording method that suppresses occurrence of curling of a paper sheet and improves adhesion of aqueous ultraviolet-curable ink.

An inkjet recording method according to a first aspect of the invention includes: a jetting step of using a paper sheet, wherein a decay rate of ultrasonic transmittance through the paper sheet after five seconds with respect to ultrasonic transmittance through the paper sheet immediately after immersion of the paper sheet in pure water is from 4% to 26%, and jetting aqueous ultraviolet-curable ink onto a front surface of the paper sheet with an inkjet recording head; a conveyance step of conveying the paper sheet to an exposure section such that an amount of time from the jetting step until exposing the aqueous ultraviolet-curable ink on the paper sheet to ultraviolet light is from 1 second to 8 seconds; and an exposure step of exposing the aqueous ultraviolet-curable ink on the paper sheet to ultraviolet light to thereby cure the aqueous ultraviolet-curable ink.

Here, "decay rate (ultrasonic decay rate)" means the decay rate (%) of ultrasonic transmittance through the paper sheet at a point in time when five seconds has elapsed when 100 represents ultrasonic transmittance through the paper sheet immediately after immersion (0 seconds) of the paper sheet in pure water.

According to the first aspect, the method uses the paper sheet where the decay rate of ultrasonic transmittance through the paper sheet after five seconds with respect to ultrasonic transmittance through the paper sheet immediately after immersion of the paper sheet in pure water is from 4% to 26% and jets the aqueous ultraviolet-curable ink onto the front surface of the paper sheet with the inkjet recording head in the jetting step. Additionally, by conveying the paper sheet to the exposure section and exposing the paper sheet in such a way that the amount of time from the jetting step until exposing the ink on the paper sheet to ultraviolet light is from 1 second to 8 seconds, an amount of penetration of the water in the ink into the paper sheet can be controlled to a preferred range. Because of this, the occurrence of curling resulting from an amount of water that has penetrated the paper sheet increasing such that swelling of the paper sheet advances can be suppressed. Moreover, adhesion deterioration of the aqueous ultraviolet-curable ink to the front surface of the paper sheet after exposure which is caused by increased amount of the residual ink on an upper surface of the paper sheet can also be suppressed. Consequently, a balance between the suppression of curling of the paper sheet and the adhesion of the aqueous ultraviolet-curable ink to the front surface of the paper sheet by exposure can be achieved.

An inkjet recording method according to a second aspect of the invention is the inkjet recording method according to the first aspect and further includes, before the jetting step, a process liquid application step of applying a process liquid to the front surface of the paper sheet and drying the process liquid, wherein the paper sheet is adjusted such that the decay rate of the paper sheet after the process liquid application step is from 4% to 26%.

According to the second aspect, the process liquid is applied to the front surface of the paper sheet and dried before the jetting step, and the paper sheet is adjusted such that the decay rate of ultrasonic transmittance through the paper sheet after five seconds with respect to ultrasonic transmittance through the paper sheet immediately after immersion of the paper sheet in pure water is from 4% to 26%. Consequently, a balance between the suppression of curling of the paper sheet and the adhesion of the aqueous ultraviolet-curable ink to the front surface of the paper sheet by exposure can be achieved.

An inkjet recording method according to a third aspect of the invention is the inkjet recording method according to the first aspect or the second aspect, wherein the aqueous ultraviolet-curable ink on the paper sheet is exposed to ultraviolet light by the exposure step in a state in which the paper sheet is conveyed while the paper sheet is sucked onto a conveyance surface and tension is applied to the paper sheet.

According to the third aspect, by exposing the aqueous ultraviolet-curable ink on the paper sheet to ultraviolet light in a state in which the paper sheet is conveyed while the paper sheet is sucked onto the conveyance surface and tension is applied to the paper sheet, the occurrence of curling of the paper sheet can be suppressed more effectively.

An inkjet recording method according to a fourth aspect of the invention is the inkjet recording method according to any of the first aspect to the third aspect, wherein in the exposure step, a peak illuminance on the front surface of the paper sheet resulting from an exposure lamp is set in a range from 0.5 $W/cm^2$ to 8.0 $W/cm^2$.

According to the fourth aspect, by setting the peak illuminance to be from 0.5 $W/cm^2$ to 8.0 $W/cm^2$, the ultraviolet-curable ink can be cured more reliably and the film strength can be ensured. When the peak illuminance is lower than 0.5 $W/cm^2$, there is the potential for polymerization reaction to be insufficient. Further, when the peak illuminance is higher than 8.0 $W/cm^2$, effect of heat on the paper sheet becomes greater.

An inkjet recording method according to a fifth aspect of the invention is the inkjet recording method according to any of the first aspect to the fourth aspect, wherein in the exposure step, an integrated amount of light on the front surface of the paper sheet resulting from an exposure lamp is set in a range from 0.1 $J/cm^2$ to 1.0 $J/cm^2$.

According to the fifth aspect, by setting the integrated amount of light to be from 0.1 $J/cm^2$ to 1.0 $J/cm^2$, the ultraviolet-curable ink can be cured even more reliably and the film strength can be ensured. When the integrated amount of light is lower than 0.1 $J/cm^2$, there is the potential for the polymerization reaction to be insufficient. Further, when the integrated amount of light is higher than 1.0 $J/cm^2$, the effect of heat on the paper sheet becomes greater.

An inkjet recording method according to a sixth aspect of the invention is the inkjet recording method according to any of the first aspect to the fifth aspect and further includes, between the jetting step and the exposure step, a drying step of drying the paper sheet onto which the aqueous ultraviolet-curable ink has been jetted.

According to the sixth aspect, by drying, between the jetting step and the exposure step, the paper sheet onto which the aqueous ultraviolet-curable ink has been jetted, swelling of the water in the aqueous ultraviolet-curable ink into the paper sheet can be suppressed.

An inkjet recording method according to a seventh aspect of the invention uses, as ink suitable to the present invention, aqueous ultraviolet-curable ink that includes at least a color material, a polymerizable monomer that is polymerized by ultraviolet light, an initiator that initiates the polymerization of the polymerizable monomer by ultraviolet light, and 50% by mass or more of water.

According to the present invention, the invention can suppress the occurrence of curling in a paper sheet and improve the adhesion of aqueous ultraviolet-curable ink.

BRIEF DESCRIPTION OF THE DRAWINGS

FIG. 8 is a table showing results of evaluating the occurrence of curling of paper sheets when an ultrasonic decay rate of the paper sheets is changed and the adhesion of the aqueous ultraviolet-curable ink

DETAILED DESCRIPTION OF THE INVENTION

An example of an embodiment pertaining to the present invention will be described below with reference to the drawings.

Apparatus Configuration

Figure 1:
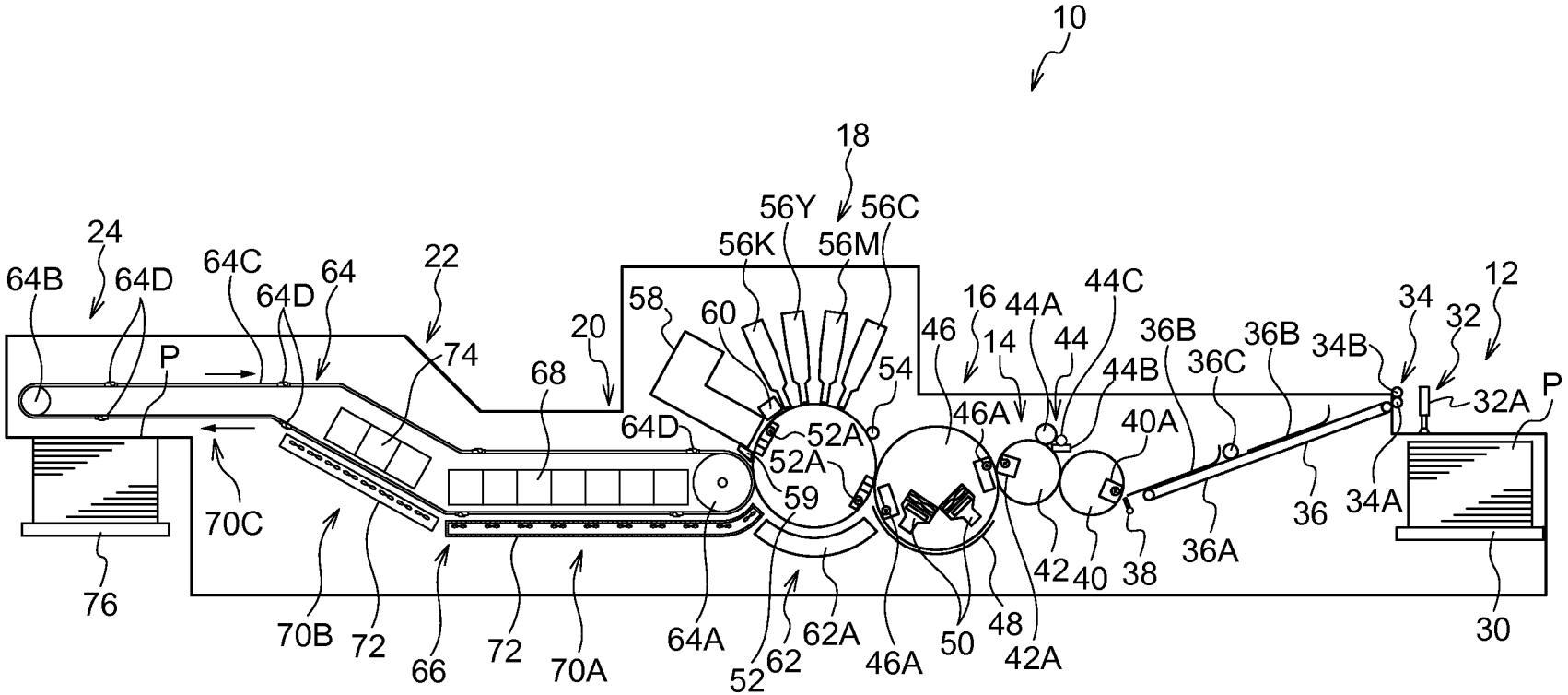
FIG. 1 is a configuration diagram showing an image forming apparatus to which an inkjet recording method pertaining to an embodiment of the present invention is applied.

FIG. 1 is an overall configuration diagram showing an embodiment of an inkjet recording apparatus 10 that serves as an image forming apparatus to which an inkjet recording method pertaining to the present invention is applied.

The inkjet recording apparatus 10 is an inkjet recording apparatus that uses aqueous UV ink (UV (ultraviolet)-curable ink using an aqueous medium) to record an image by the inkjet format on paper sheets (recording medium) P. The inkjet recording apparatus 10 is mainly equipped with a paper feed section 12 that feeds the paper sheets P, a process liquid application section 14 that applies a predetermined process liquid to front surfaces (printing surfaces or image recording surfaces) of the paper sheets P that have been fed from the paper feed section 12, a process liquid drying treatment section 16 that administers a drying treatment to the paper sheets P to which the process liquid has been applied by the process liquid application section 14, an image recording section 18 that uses aqueous UV ink to record an image by the inkjet format on the front surfaces of the paper sheets P to which the drying treatment has been administered by the process liquid drying treatment section 16, an ink drying treatment section 20 that administers a drying treatment to the paper sheets P on which the images have been recorded by the image recording section 18, a UV irradiation treatment section (exposure section) 22 that administers a UV irradiation treatment (fixing treatment) to the paper sheets P to which the drying treatment has been administered by the ink drying treatment section 20 to thereby fix the images, and a paper discharge section 24 that discharges the paper sheets P to which the UV irradiation treatment has been administered by the UV irradiation treatment section 22.

(Paper Feed Section)

The paper feed section 12 feeds the paper sheets P, which are stacked in a paper feed tray 30, one sheet at a time to the process liquid application section 14. The paper feed section 12 that serves as an example of paper feeding means is mainly configured by the paper feed tray 30, a sucker device 32, a paper feed roller pair 34, a feeder board 36, a feed guide 38, and a paper feed drum 40.

The paper sheets P are placed in the paper feed tray 30 as a stack in which numerous sheets are stacked on top of each other. The paper feed tray 30 is disposed in such a way that it can be raised and lowered by an unillustrated paper feed tray raising-and-lowering device. Driving of the paper feed tray raising-and-lowering device is controlled in conjunction with increases and decreases in the number of the paper sheets P stacked in the paper feed tray 30. The paper feed tray raising-and-lowering device raises and lowers the paper feed tray 30 such that the paper sheet P positioned in the uppermost position of the stack is always positioned at a fixed height.

The sucker device 32 picks up, one sheet at a time sequentially from above, the paper sheets P stacked in the paper feed tray 30 and feeds the paper sheets P to the paper feed roller pair 34. The sucker device 32 is equipped with a suction foot 32A that is disposed in such a way that it may be freely raised and lowered and freely swung. The sucker device 32 sucks and holds the upper surface of the paper sheet P with the suction foot 32A and transfers the paper sheet P from the paper feed tray 30 to the paper feed roller pair 34. At this time, the suction foot 32A sucks and holds the upper surface on a leading end side of the paper sheet P positioned in the uppermost position of the stack, pulls up the paper sheet P, and inserts a leading end of the paper sheet P which has been pulled up between a pair of rollers 34A and 34B configuring the paper feed roller pair 34.

The paper feed roller pair 34 is configured by an upper and lower pair of rollers 34A and 34B that are pressed against and brought into contact with each other. One of the upper and lower pair of rollers 34A and 34B is configured to serve as a drive roller (the roller 34A) and the other is configured to serve as a driven roller (the roller 34B). The drive roller (the roller 34A) is driven to rotate by an unillustrated motor. The motor is driven in conjunction with the feeding of the paper sheet P, and when the paper sheet P is fed from the sucker device 32, the motor causes the drive roller (the roller 34A) to rotate in accordance with the timing of the feeding. The paper sheet P that has been inserted between the upper and lower pair of rollers 34A and 34B is nipped by the rollers 34A and 34B and is fed in a direction of rotation of the rollers 34A and 34B (an installation direction of the feeder board 36).

The feeder board 36 is formed in correspondence to a width of the paper sheets P, receives the paper sheet P that has been fed from the paper feed roller pair 34, and guides the paper sheet P to the feed guide 38. The feeder board 36 is installed so as to incline downward, allows the paper sheet P that has been placed on top of its conveyance surface to slide along the conveyance surface, and guides the paper sheet P to the feed guide 38.

Tape feeders 36A for conveying the paper sheet P are plurally installed, at intervals apart from each other in the width direction, on the feeder board 36. The tape feeders 36A are formed in endless shapes and are driven to rotate by an unillustrated motor. The paper sheet P that has been placed on the conveyance surface of the feeder board 36 is fed by the tape feeders 36A and is conveyed on top of the feeder board 36.

Further, retainers 36B and a roller 36C are installed on top of the feeder board 36. The retainers 36 are plurally placed at upstream and downstream in a longitudinal row along a conveyance surface of the paper sheet P (in the present example, there are two retainers 36B). The retainers 36B are configured by plate springs that have a width corresponding to the width of the paper sheets P. The retainers 36B are installed in such a way that they are pressed against and brought into contact with the conveyance surface. The paper sheet P conveyed on top of the feeder board 36 by the tape feeders 36A passes through the retainers 36B, whereby unevenness is corrected. The retainers 36B are formed such that their rear end portions are curled in order to make it easier to introduce the paper sheet P between the retainers 36B and the feeder board 36.

The roller 36C is disposed between the upstream and downstream retainers 36B. The roller 36C is installed such that it is pressed against and brought into contact with the conveyance surface of the paper sheet P. The paper sheet P conveyed between the upstream and downstream retainers 36B is conveyed while its upper surface is pressed down by the roller 36C.

The feed guide 38 corrects a posture of the paper sheet P. The feed guide 38 is formed in a plate shape and is placed orthogonal to the conveyance direction of the paper sheet P. Further, the feed guide 38 is driven by an unillustrated motor and is disposed such that it can swing. The leading end of the paper sheet P that has been conveyed on top of the feeder board 36 is brought into contact with the feed guide 38, whereby the posture of the paper sheet P is corrected (so-called skew prevention). The feed guide 38 swings in conjunction with the feeding of the paper sheet P to the paper feed drum 40 and transfers the paper sheet P whose posture has been corrected to the paper feed drum 40.

The paper feed drum 40 receives the paper sheet P fed from the feeder board 36 via the feed guide 38 and conveys the paper sheet P to the process liquid application section 14. The paper feed drum 40 is formed in a cylindrical shape and is driven to rotate by an unillustrated motor. A gripper 40A is disposed on an outer peripheral surface of the drum 40, and the leading end of the paper sheet P is gripped by the gripper 40A. The drum 40 grips the leading end of the paper sheet P with the gripper 40A and rotates, whereby the drum 40 wraps the paper sheet P onto its peripheral surface and conveys the paper sheet P to the process liquid application section 14.

(Process Liquid Application Section)

The process liquid application section 14 applies a predetermined process liquid to the front surface (image recording surface) of the paper sheet P. The process liquid application section 14 is mainly configured by a process liquid application drum 42 that conveys the paper sheet P and a process liquid application unit 44 that applies the predetermined process liquid to a printing surface of the paper sheet P conveyed by the process liquid application drum 42.

The process liquid application drum 42 receives the paper sheet P from the paper feed drum 40 of the paper feed section 12 and conveys the paper sheet P to the process liquid drying treatment section 16. The process liquid application drum 42 is formed in a cylindrical shape and is driven to rotate by an unillustrated motor. A gripper 42A is disposed on an outer peripheral surface of the drum 42. The drum 42 grips the leading end of the paper sheet P with the gripper 42A and rotates, whereby the drum 42 wraps the paper sheet P onto its peripheral surface and conveys the paper sheet P to the process liquid drying treatment section 16 (the drum 42 conveys one paper sheet P by one rotation). The rotation of the process liquid application drum 42 and the rotation of the paper feed drum 40 are controlled in such a way that timing of the receipt of the paper sheet P by the process liquid application drum 42 and timing of the transfer of the paper sheet P by the paper feed drum 40 coincide. That is, the process liquid application drum 42 and the paper feed drum 40 are driven such that they have the same circumferential speed and the positions of their respective grippers coincide.

The process liquid application unit 44 applies the process liquid by means of a roller to the front surface of the paper sheet P conveyed by the process liquid application drum 42. The process liquid application unit 44 is mainly configured by an application roller 44A that applies the process liquid to the paper sheet P, a process liquid tank 44B in which the process liquid is stored, and a draw roller 44C that draws up the process liquid stored in the process liquid tank 44B and supplies the process liquid to the application roller 44A. The draw roller 44C is installed such that it presses against and contacts the application roller 44A and a part of the draw roller 44C is immersed in the process liquid stored in the process liquid tank 44B. The draw roller 44C measures and draws up the process liquid and applies the process liquid in a fixed thickness to the peripheral surface of the application roller 44A. The application roller 44A is disposed in correspondence to the width of the paper sheets P, is pressed against and brought into contact with the paper sheet P, and applies to the paper sheet P the process liquid that has been applied to the peripheral surface of the application roller 44A. The application roller 44A is driven by an unillustrated reciprocating mechanism and moves between a contact position in which the application roller 44A contacts the peripheral surface of the process liquid application drum 42 and a retracted position in which the application roller 44A is retracted from the peripheral surface of the process liquid application drum 42. A reciprocating mechanism moves the application roller 44A in accordance with timing of the passage of the paper sheet P to apply the process liquid to the front surface of the paper sheet P conveyed by the process liquid application drum 42.

In the present example, the process liquid application unit 44 is given a configuration that applies the process liquid by means of a roller, but the method of applying the process liquid is not limited to this. In addition to this, a configuration that uses an inkjet head to apply the process liquid or a configuration that applies the process liquid by spraying the process liquid can also be employed.

Here, the process liquid applied to the front surface of the paper sheet P has the function of causing the color material in the aqueous UV ink to aggregate, the ink will be ejected onto the paper sheet P by the downstream image recording section 18. By applying the process liquid to the front surface of the paper sheet P and ejecting the aqueous UV ink, high-definition printing can be performed without causing landing interference of the ink or the like even in the case of using general-purpose printing paper.

(Process Liquid Drying Treatment Section)

The process liquid drying treatment section 16 administers a drying treatment to the paper sheet P on which the process liquid has been applied. The process liquid drying treatment section 16 is mainly configured by a process liquid drying treatment drum 46 that conveys the paper sheet P, a paper sheet conveyance guide 48, and a process liquid drying treatment unit 50 that blows hot air onto the printing surface of the paper sheet P conveyed by the process liquid drying treatment drum 46 to thereby dry the printing surface of the paper sheet P.

The process liquid drying treatment drum 46 receives the paper sheet P from the process liquid application drum 42 of the process liquid application section 14 and conveys the paper sheet P to the image recording section 18. The drum 46 is configured by a frame body assembled in a cylindrical shape and is driven to rotate by an unillustrated motor. A gripper 46A is disposed on an outer peripheral surface of the drum 46. The drum 46 grips the leading end of the paper sheet P with the gripper 46A and rotates, whereby the drum 46 conveys the paper sheet P to the image recording section 18. The drum 46 in the present example is configured in such a way that the gripper 46A is disposed in two places on the outer peripheral surface of the process liquid drying treatment drum 46 so that two of the paper sheets P can be conveyed by one rotation. The rotation of the process liquid drying treatment drum 46 and the rotation of the process liquid application drum 42 are controlled such that the timing of the receipt of the paper sheet P by the process liquid drying treatment drum 46 and the timing of the transfer of the paper sheet P by the process liquid application drum 42 coincide. That is, the process liquid drying treatment drum 46 and the process liquid application drum 42 are driven such that they have the same circumferential speed and the positions of their respective grippers coincide.

The paper sheet conveyance guide 48 is disposed along a conveyance path of the paper sheet P provided by the process liquid drying treatment drum 46 and guides the conveyance of the paper sheet P.

The process liquid drying treatment unit 50 is installed on the inside of the process liquid drying treatment drum 46 and blows hot air toward the front surface of the paper sheet P conveyed by the drum 46 to thereby administer a drying treatment to the paper sheet P (a process liquid application step in the present embodiment). In the present example, two of the process liquid drying treatment units 50 are disposed inside the drum 46 and are given a configuration that blows hot air toward the front surface of the paper sheet P conveyed by the drum 46.

The process liquid drying treatment section 16 is configured as described above. The paper sheet P that has been transferred from the process liquid application drum 42 of the process liquid application section 14 is received by the process liquid drying treatment drum 46. The drum 46 grips the leading end of the paper sheet P with the gripper 46A and rotates, whereby the drum 46 conveys the paper sheet P. At this time, the drum 46 conveys the paper sheet P such that the front surface of the paper sheet P (the surface to which the process liquid has been applied) faces inside. In the process of the paper sheet P being conveyed by the process liquid drying treatment drum 46, hot air is blown onto the front surface of the paper sheet P from the process liquid drying treatment unit 50 installed on the inside of the drum 46, whereby the drying treatment is administered. That is, the solvent component in the process liquid is removed. Because of this, a cohesive layer of ink is formed on the front surface of the paper sheet P.

(Image Recording Section)

The image recording section 18 ejects liquid droplets of ink (aqueous UV ink) of the colors of C, M, Y, and K onto the printing surface of the paper sheet P to thereby draw a color image on the printing surface of the paper sheet P. The image recording section 18 is mainly configured by an image recording drum 52 that conveys the paper sheet P, a paper sheet holding roller 54 that presses the paper sheet P conveyed by the image recording drum 52 to thereby bring the paper sheet P into close contact with the peripheral surface of the image recording drum 52, inkjet heads (inkjet recording heads) 56C, 56M, 56Y, and 56K that serve as an example of jetting heads that jet ink droplets of the colors of C, M, Y, and K onto the paper sheet P, an inline sensor 58 that reads the image that has been recorded on the paper sheet P, a mist filter 60 that traps ink mist, and a drum cooling unit 62.

The image recording drum 52 receives the paper sheet P from the process liquid drying treatment drum 46 of the process liquid drying treatment section 16 and conveys the paper sheet P to the ink drying treatment section 20. The image recording drum 52 is formed in a cylindrical shape and is driven to rotate by an unillustrated motor. A gripper 52A is disposed on the outer peripheral surface of the drum 52. The drum 52 grips the leading end of the paper sheet P with a gripper 52A and rotates, whereby the image recording drum 52 wraps the paper sheet P onto its peripheral surface and conveys the paper sheet P to the ink drying treatment section 20. Further, numerous suction holes (not shown in the drawings) are formed in a predetermined pattern in the peripheral surface of the drum 52. The paper sheet P that has been wrapped onto the peripheral surface of the drum 52 is sucked from the section holes, whereby the paper sheet P is conveyed while being sucked and held on the peripheral surface of the drum 52. Because of this, the paper sheet P can be conveyed with a high degree of smoothness.

The suction from the suction holes acts only in a fixed range and acts between a predetermined start-of-suction position and a predetermined end-of-suction position. The start-of-suction position is set in the installation position of the paper sheet holding roller 54, and the end-of-suction position is set on the downstream side of the installation position of the inline sensor 58 (e.g., the end-of-suction position is set in the position at which the image recording drum 52 transfers the paper sheet P to the ink drying treatment section 20). That is, the start-of-suction position and the end-of-suction position are set in such a way that the paper sheet P is sucked and held on the peripheral surface of the image recording drum 52 at least in the installation position of the inkjet heads 56C, 56M, 56Y, and 56K (which is an image recording position) and the installation position of the inline sensor 58 (which is an image reading position).

The mechanism by which the paper sheet P is sucked and held on the peripheral surface of the image recording drum 52 is not limited to the suction method resulting from negative pressure described above and can also employ a method resulting from electrostatic attraction.

Further, the image recording drum 52 in the present example is configured in such a way that the gripper 52A is disposed in two places on the outer peripheral surface so that two of the paper sheets P can be conveyed by one rotation. The rotation of the image recording drum 52 and the rotation of the process liquid drying treatment drum 46 are controlled such that timing of the receipt of the paper sheet P by the image recording drum 52 and timing of the transfer of the paper sheet P by the process liquid drying treatment drum 46 coincide. That is, the image recording drum 52 and the process liquid drying treatment drum 46 are driven in such a way that they have the same circumferential speed and the positions of their respective grippers coincide.

The paper sheet holding roller 54 is disposed in the neighborhood of a paper sheet receiving position of the image recording drum 52 (the position at which the image recording drum 52 receives the paper sheet P from the process liquid drying treatment drum 46). The paper sheet holding roller 54 is configured by a rubber roller and is installed such that it is pressed against and brought into contact with the peripheral surface of the image recording drum 52. The paper sheet P that has been transferred from the process liquid drying treatment drum 46 to the image recording drum 52 is nipped and brought into close contact with the peripheral surface of the drum 52 as the paper sheet P passes through the paper sheet holding roller 54.

The four inkjet heads 56C, 56M, 56Y, and 56K are placed at fixed intervals apart from each other along a conveyance path of the paper sheet P provided by the image recording drum 52. The inkjet heads 56C, 56M, 56Y, and 56K are configured by line heads corresponding to the width of the paper sheets P and are placed in such a way that their nozzle surfaces oppose the peripheral surface of the image recording drum 52. The inkjet heads 56C, 56M, 56Y, and 56K jet liquid droplets of ink from nozzle rows formed in their nozzle surfaces toward the image recording drum 52 to thereby record an image on the paper sheet P conveyed by the image recording drum 52.

As mentioned above, aqueous UV ink is used for the ink jetted from the inkjet heads 56C, 56M, 56Y, and 56K. The aqueous UV ink can be cured by irradiating it with ultraviolet (UV) light after the aqueous UV ink has been ejected.

The inline sensor 58 is installed on the downstream side of the last inkjet head 56K with respect to a conveyance direction of the paper sheet P resulting from the image recording drum 52 and reads the image that has been recorded by the inkjet heads 56C, 56M, 56Y, and 56K. The inline sensor 58 is configured by a line scanner, for example, and reads the image that has been recorded by the inkjet heads 56C, 56M, 56Y, and 56M on the paper sheet P conveyed by the image recording drum 52.

A contact prevention plate 59 is installed on the downstream side of the inline sensor 58 in proximity to the line sensor 58. The contact prevention plate 59 prevents the paper sheet P from contacting the inline sensor 58 in a case where lift has occurred in the paper sheet P due to conveyance trouble or the like.

The mist filter 60 is disposed between the last inkjet head 56K and the inline sensor 58 and sucks in the air around the image recording drum 52 to trap ink mist. In this way, by sucking in the air around the image recording drum 52 to trap ink mist, the ingress of ink mist into the inline sensor 58 can be prevented and the occurrence of reading defects and so forth can be prevented.

The drum cooling unit 62 blows cold air onto the image recording drum 52 to thereby cool the image recording drum 52. The drum cooling unit 62 is mainly configured by an air conditioner (not shown in the drawings) and a duct 62A that blows cold air supplied from the air conditioner onto the peripheral surface of the image recording drum 52. The duct 62A blows the cold air onto a region of the image recording drum 52 outside the region that conveys the paper sheet P to thereby cool the image recording drum 52. In the present example, the paper sheet P is conveyed along a circular arc surface substantially on the upper half of the image recording drum 52, so the duct 62A is given a configuration that blows the cold air onto the region of substantially the lower half of the image recording drum 52 to thereby cool the image recording drum 52. Specifically, the duct 62A is given a configuration where the air outlet of the duct 62A is formed in a circular arc shape so as to cover and blow the cold air substantially onto the region of substantially the lower half of the image recording drum 52.

Here, a temperature to which the drum cooling unit 62 cools the image recording drum 52 is determined by its relationship to a temperature of the inkjet heads 56C, 56M, 56Y, and 56K (particularly the temperature of the nozzle surfaces), and the image recording drum 52 is cooled in such a way that its temperature becomes lower than the temperature of the inkjet heads 56C, 56M, 56Y, and 56K. Because of this, dew condensation can be prevented from forming on the inkjet heads 56C, 56M, 56Y, and 56K. That is, by making the temperature of the image recording drum 52 lower than the temperature of the inkjet heads 56C, 56M, 56Y, and 56K, dew condensation can be induced on the image recording drum 52 side, and dew condensation forming on the inkjet heads 56C, 56M, 56Y, and 56K (particularly dew condensation forming on their nozzle surfaces) can be prevented.

The image recording section 18 is configured as described above. The paper sheet P that has been transferred from the process liquid drying treatment drum 46 of the process liquid drying treatment section 16 is received by the image recording drum 52. The drum 52 grips the leading end of the paper sheet P with the gripper 52A and rotates, whereby the drum 52 conveys the paper sheet P. The paper sheet P that has been transferred to the image recording drum 52 first passes through the paper sheet holding roller 54, whereby the paper sheet P is brought into close contact with the peripheral surface of the image recording drum 52. At the same time as this, the paper sheet P is sucked from the suction holes in the image recording drum 52 and is sucked and held on the outer peripheral surface of the image recording drum 52. The paper sheet P is conveyed in this state and passes the inkjet heads 56C, 56M, 56Y, and 56K. Then, at the time of the passage, liquid droplets of ink of the colors of C, M, Y, and K are ejected onto the front surface of the paper sheet P from the inkjet heads 56C, 56M, 56Y, and 56K, whereby a color image is drawn on the front surface of the paper sheet P (a jetting step in the present embodiment). A cohesive layer of ink is formed on the front surface of the paper sheet P, so a high-definition image can be recorded without causing feathering or bleeding.

The paper sheet P on which the image has been recorded by the inkjet heads 56C, 56M, 56Y, and 56K next passes the inline sensor 58. Then, the image recorded on the paper sheet P is read at the time when the paper sheet P passes the line sensor 58. The reading of the recorded image is performed as needed, and an inspection of jetting defects and so forth is performed for the image that has been read. When reading is performed, it is done so in a state in which the paper sheet P is sucked and held on the image recording drum 52, so reading can be performed with high precision. Further, reading is performed immediately after image recording, so abnormalities such as jetting defects, for example, can be immediately detected, and measures for handling those abnormalities can be speedily taken. Because of this, defective recording can be prevented, and waste sheets can be kept to a minimum.

After this, the paper sheet P is transferred to the ink drying treatment section 20 after the suction is cancelled.

(Ink Drying Treatment Section)

The ink drying treatment section 20 administers a drying treatment to the paper sheet P after image recording to remove liquid component remaining on the front surface of the paper sheet P. The ink drying treatment section 20 is mainly configured by a chain gripper 64 that serves as an example of conveying means that conveys the paper sheet P on which the image has been recorded, a back tension application mechanism 66 that serves as an example of back tension applying means that applies back tension to the paper sheet P conveyed by the chain gripper 64, and ink drying treatment units 68 that serve as an example of drying units that administer a drying treatment to the paper sheet P conveyed by the chain gripper 64.

The chain gripper 64 is a paper sheet conveyance mechanism used in common by the ink drying treatment section 20, the UV irradiation treatment section 22, and the paper discharge section 24. The chain gripper 64 receives the paper sheet P that has been transferred from the image recording section 18 and conveys the paper sheet P to the paper discharge section 24.

The chain gripper 64 is mainly configured by a first sprocket 64A that is installed in proximity to the image recording drum 52, a second sprocket 64B that is installed in the paper discharge section 24, an endless chain 64C that is wrapped around the first sprocket 64A and the second sprocket 64B, plural chain guides (not shown in the drawings) that guide the travel of the chain 64C, and plural grippers 64D that are attached at fixed intervals apart from each other to the chain 64C. The first sprocket 64A, the second sprocket 64B, the chain 64C, and the chain guides are each configured in pairs and are disposed on both sides in the width direction of the paper sheet P. The grippers 64D are installed so as to span the chains 64C disposed in a pair.

The first sprocket 64A is installed in proximity to the image recording drum 52 so that the paper sheets P transferred from the image recording drum 52 can be received by the grippers 64D. The first sprocket 64A is supported by an unillustrated bearing, is disposed such that it may freely rotate, and is coupled to an unillustrated motor. The chain 64C wrapped around the first sprocket 64A and the second sprocket 64B travels as a result of the motor being driven.

The second sprocket 64B is installed in the paper discharge section 24 so that the paper sheet P that has been received from the image recording drum 52 can be collected by the paper discharge section 24. That is, the installation position of the second sprocket 64B is configured to be at the terminal end of a conveyance path of the paper sheet P provided by the chain gripper 64. The second sprocket 64B is supported by an unillustrated bearing and is disposed such that it may freely rotate.

The chain 64C is formed in an endless shape and is wrapped around the first sprocket 64A and the second sprocket 64B.

The chain guides are placed in predetermined positions and guide the chain 64C in such a way that the chain 64C travels a predetermined path (i.e., the chain guides guide the chain 64C in such a way that the paper sheet P travels and is conveyed on a predetermined conveyance path). In the inkjet recording apparatus 10 of the present example, the second sprocket 64B is disposed in a higher position than the first sprocket 64A. For this reason, a traveling path in which the chain 64C inclines midway is formed. Specifically, the traveling path is configured by a first horizontal conveyance path 70A, an inclined conveyance path 70B, and a second horizontal conveyance path 70C.

The first horizontal conveyance path 70A is set to the same height as the first sprocket 64A and is set such that the chain 64C wrapped around the first sprocket 64A travels horizontally. The second horizontal conveyance path 70C is set to the same height as the second sprocket 64B and is set such that the chain 64C wrapped around the second sprocket 64B travels horizontally. The inclined conveyance path 70B is set between the first path 70A and the second path 70C and is set in such a way as to join the first path 70A and the second path 70C.

The chain guides are disposed so as to form the first horizontal conveyance path 70A, the inclined conveyance path 70B, and the second horizontal conveyance path 70C. Specifically, the chain guides are disposed at least in the points where the first horizontal conveyance path 70A and the inclined conveyance path 70B join to each other and in the points where the inclined conveyance path 70B and the second horizontal conveyance path 70C join to each other.

The grippers 64D are plurally attached at fixed intervals apart from each other to the chain 64C. The interval at which the grippers 64D are attached are set so as to correspond to an intervals at which the grippers 64D receive the paper sheets P from the image recording drum 52. That is, the interval at which the grippers 64D are attached are set in correspondence to the interval at which the grippers 64D receive the paper sheets P from the image recording drum 52 so that the grippers 64D can match timings of, and receive from the image recording drum 52, the paper sheets P successively transferred from the image recording drum 52.

As mentioned above, when the motor (not shown in the drawings) connected to the first sprocket 64A is driven, the chain 64C travels. The chain 64C travels at the same speed as a circumferential speed of the image recording drum 52. Further, the timings are matched in such a way that the paper sheets P transferred from the image recording drum 52 are received by the grippers 64D.

Figure 2:
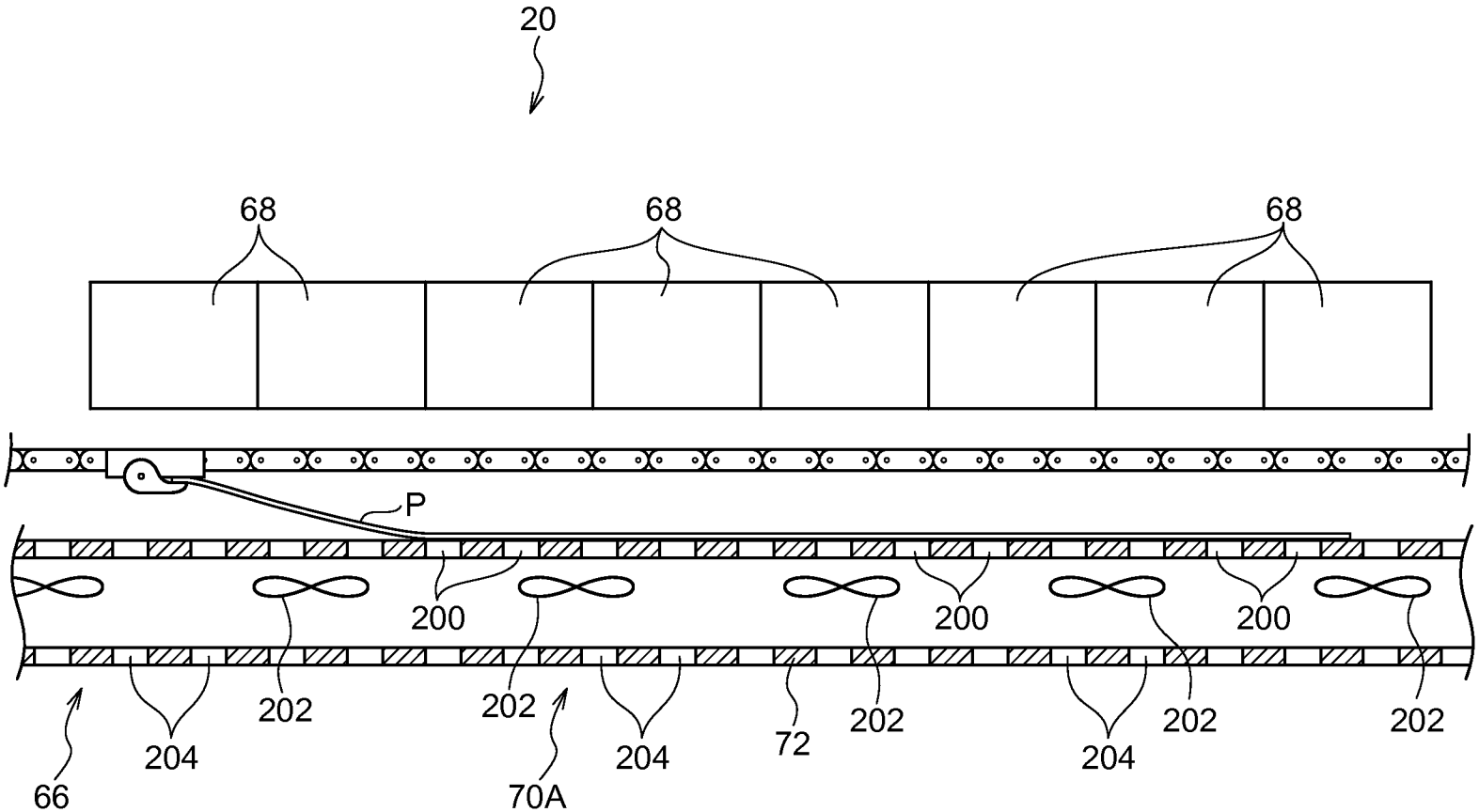
FIG. 2 is a configuration diagram showing the vicinity of an ink drying treatment section of the image forming apparatus shown in FIG. 1 and shows a state in which a paper sheet P is conveyed by a chain gripper while being sucked onto a guide plate.

The back tension application mechanism 66 applies back tension to the paper sheet P that is conveyed with its leading end gripped by the chain gripper 64. As shown in FIG. 2, the back tension application mechanism 66 is mainly configured by a guide plate 72 that serves as a conveyance surface and plural suction fans 202 that suck in air from numerous suction holes 200 formed in the upper surface of the guide plate 72. Further, numerous holes 204 for blowing out the sucked-in air are disposed in the lower surface of the guide plate 72.

The guide plate 72 is configured by a hollow box plate that has a width corresponding to the width of the paper sheets P. The guide plate 72 is disposed along the conveyance path of the paper sheet P provided by the chain gripper 64 (i.e., the traveling path of the chain 64C). Specifically, the guide plate 72 is disposed along the chain 64C that travels the first horizontal conveyance path 70A and the inclined conveyance path 70B, and the guide plate 72 is disposed a predetermined distance apart from the chain 64C. The paper sheet P conveyed by the chain gripper 64 is conveyed with its back surface (the surface on the side on which the image is not recorded) sliding on and contacting the upper surface (the surface opposing the chain 64C: a sliding contact surface) of the guide plate 72.

The numerous suction holes 200 are formed in a predetermined pattern in the sliding contact surface (the upper surface) of the guide plate 72. As mentioned above, the guide plate 72 is formed by a hollow box plate. The suction fans 202 suck air into the hollow portion (the inside) of the guide plate 72. Because of this, air is sucked in from the suction holes 200 formed in the sliding contact surface.

Air is sucked in from the suction holes 200 in the guide plate 72, whereby the back surface of the paper sheet P conveyed by the chain gripper 64 is sucked by the suction holes 200. Because of this, back tension is applied to the paper sheet P.

As mentioned above, the guide plate 72 is disposed along the chain 64C that travels the first horizontal conveyance path 70A and the inclined conveyance path 70B, so back tension is applied while the paper sheet P is conveyed on the first horizontal conveyance path 70A and the inclined conveyance path 70B.

As shown in FIG. 1, the ink drying treatment units 68 are installed inside the chain gripper 64 (particularly in the site configuring the first horizontal conveyance path 70A) and administer the drying treatment with respect to the paper sheet P conveyed on the first horizontal conveyance path 70A. The ink drying treatment units 68 administer the drying treatment by blowing hot air onto the front surface of the paper sheet P conveyed on the first horizontal conveyance path 70A. The ink drying treatment units 68 are plurally placed along the first horizontal conveyance path 70A. The number of the ink drying treatment units 68 that are installed is set in accordance with, for example, the processing capability of the ink drying treatment units 68 and the conveyance speed (i.e., the printing speed) of the paper sheet P. That is, the number of the ink drying treatment units 68 that are installed is set in such a way that the paper sheet P that has been received from the image recording section 18 can be dried while the paper sheet P is being conveyed on the first horizontal conveyance path 70A. Consequently, the length of the first horizontal conveyance path 70A is also set in consideration of the capability of the ink drying treatment units 68.

The paper sheet P that has been transferred from the image recording drum 52 of the image recording section 18 is received by the chain gripper 64. The chain gripper 64 grips the leading end of the paper sheet P with the gripper 64D and conveys the paper sheet P along the planar guide plate 72. The paper sheet P that has been transferred to the chain gripper 64 is first conveyed on the first horizontal conveyance path 70A. In the process of the paper sheet P being conveyed on the first horizontal conveyance path 70A, the drying treatment is administered to the paper sheet P by the ink drying treatment units 68 installed inside the chain gripper 64. That is, hot air is blown onto the front surface (image recording surface) of the paper sheet P, whereby the drying treatment is administered. At this time, the drying treatment is administered to the paper sheet P while back tension is applied to the paper sheet P by the back tension application mechanism 66. Because of this, the drying treatment can be administered while suppressing deformation of the paper sheet P.

(UV Irradiation Treatment Section (Exposure Section))

The UV irradiation treatment section (exposure section) 22 applies ultraviolet (UV) light to the image that has been recorded using aqueous UV ink to thereby fix the image. The UV irradiation treatment section 22 is mainly configured by the chain gripper 64 that conveys the paper sheet P, the back tension application mechanism 66 that applies back tension to the paper sheet P conveyed by the chain gripper 64, and UV irradiation units 74 that serve as an example of fixing units that apply ultraviolet light to the paper sheet P conveyed by the chain gripper 64.

As mentioned above, the chain gripper 64 and the back tension application mechanism 66 are used in common by the ink drying treatment section 20 and the paper discharge section 24.

The UV irradiation units 74 are installed inside the chain gripper 64 (particularly in the site configuring the inclined conveyance path 70B) and apply ultraviolet light to the front surface of the paper sheet P conveyed on the inclined conveyance path 70B. The UV irradiation units 74 are equipped with ultraviolet lamps (UV lamps) and are plurally disposed along the inclined conveyance path 70B. Additionally, the UV irradiation units 74 apply ultraviolet light toward the front surface of the paper sheet P conveyed on the inclined conveyance path 70B. The number of the UV irradiation units 74 that are installed is set in accordance with, for example, the conveyance speed (i.e., the printing speed) of the paper sheet P. That is, the number of the UV irradiation units 74 that are installed is set in such a way that the image can be fixed by the ultraviolet light that has been applied while the paper sheet P is being conveyed on the inclined conveyance path 70B. Consequently, the length of the inclined conveyance path 70B is also set in consideration of the conveyance speed of the paper sheet P and so forth.

The paper sheet P that is conveyed by the chain gripper 64 and to which the drying treatment has been administered by the ink drying treatment section 20 is next conveyed on the inclined conveyance path 70B. In the process of the paper sheet P being conveyed on the inclined conveyance path 70B, the UV irradiation treatment is administered to the paper sheet P by the UV irradiation units 74 installed inside the chain gripper 64. That is, ultraviolet light is applied from the UV irradiation units 74 toward the front surface of the paper sheet P (an exposure step in the present embodiment). At this time, the UV irradiation treatment is administered to the paper sheet P while back tension is applied to the paper sheet P by the back tension application mechanism 66. Because of this, the UV irradiation treatment can be administered while suppressing deformation of the paper sheet P. Further, the UV irradiation treatment section 22 is installed on the inclined conveyance path 70B, and an inclined guide plate 72 is installed on the inclined conveyance path 70B, so even supposing that the paper sheet P has dropped from the gripper 64D during conveyance, the paper sheet P can be allowed to slide on the guide plate 72 and be discharged.

(Paper Discharge Section)

The paper discharge section 24 collects the paper sheets P on which the series of image recording processes has been performed. The paper discharge section 24 is mainly configured by the chain gripper 64 that conveys the paper sheets P that have been irradiated with ultraviolet light and a paper discharge tray 76 that stacks and collects the paper sheets P.

As mentioned above, the chain gripper 64 is used in common by the ink drying treatment section 20 and the UV irradiation treatment section 22. The chain gripper 64 releases the paper sheets P above the paper discharge tray 76 and stacks the paper sheets P in the paper discharge tray 76.

The paper discharge tray 76 stacks and collects the paper sheets P that have been released from the chain gripper 64. Paper guides (a front paper guide, a rear paper guide, lateral paper guides, etc.) are disposed on the paper discharge tray 76 so that the paper sheets P are stacked in an orderly manner (not shown in the drawings).

Further, the paper discharge tray 76 is disposed in such a way that it can be raised and lowered by an unillustrated paper discharge tray raising-and-lowering device. The driving of the paper discharge tray raising-and-lowering device is controlled in conjunction with increases and decreases in the number of the paper sheets P stacked in the paper discharge tray 76 whereby the paper sheet P positioned in the uppermost position is always positioned at a fixed height.

(Aqueous UV Ink)

Here, the aqueous UV ink (aqueous ultraviolet-curable ink) used in the present invention will be described. The aqueous ultraviolet-curable ink includes a pigment, polymer particles, and a polymerizable compound that is polymerized by an active energy ray. In particular, in the present embodiment, the aqueous ultraviolet-curable ink preferably includes at least a color material, a polymerizable monomer that is polymerized by ultraviolet light, an initiator that initiates the polymerization of the polymerizable monomer by ultraviolet light, and 50% by mass or more of water. Because of this, the aqueous UV ink can be cured by irradiating it with ultraviolet light, the aqueous UV ink has good abrasion resistance, and the film strength becomes higher.

The ink composition in the present invention includes a pigment and can be configured further using a dispersant, a surfactant, and other components as needed. The ink composition contains at least one type of pigment as the color material component. There are no particular restrictions on the pigment, and the pigment can be appropriately selected in accordance with the purpose. For example, the pigment may be an organic pigment or an inorganic pigment. In terms of ink colorability, the pigment is preferably a pigment that is virtually insoluble or sparingly soluble in water. Further, the pigment is preferably a water-dispersible pigment where at least part of its surface is covered by a polymer dispersant.

The ink composition of the present invention can contain at least one type of dispersant. The dispersant for the pigment may be a polymer dispersant or a low molecular weight surfactant dispersant. Further, the polymer dispersant may be a water-soluble dispersant or a water-insoluble dispersant.

The weight average molecular weight of the polymer dispersant is preferably 3,000 to 100,000, more preferably 5,000 to 50,000, even more preferably 5,000 to 40,000, and particularly preferably 10,000 to 40,000.

The acid value of the polymer dispersant is preferably equal to or less than 100 mg KOH/g from the standpoint of achieving good aggregability upon contact with the process liquid. Moreover, the acid value is more preferably 25 to 100 mg KOH/g, even more preferably 25 to 80 mg KOH/g, and particularly preferably 30 to 65 mg KOH/g. When the acid value of the polymer dispersant is equal to or greater than 25, the stability of self-dispersal is good.

From the standpoint of self-dispersal and aggregation speed upon contact with the process liquid, the polymer dispersant preferably includes a polymer having a carboxyl group and more preferably includes a polymer having a carboxyl group and an acid value of 25 to 80 mg KOH/g.

In the present embodiment, from the standpoint of the light resistance and quality of the image, the ink composition preferably includes a pigment and a dispersant, more preferably includes an organic pigment and a polymer dispersant, and particularly preferably includes an organic pigment and a polymer dispersant that includes a carboxyl group. Further, the pigment is preferably covered by a polymer dispersant having a carboxyl group from the standpoint of aggregability and is water-insoluble. Moreover, from the standpoint of aggregability, the acid value of the particles of a later-described self-dispersing polymer is preferably smaller than the acid value of the polymer dispersant.

The average particle size of the pigment is preferably 10 to 200 nm, more preferably 10 to 150 nm, and even more preferably 10 to 100 nm. When the average particle size is equal to or less than 200 nm, color reproducibility is good and droplet ejection characteristics when ejecting droplets by the inkjet method are good. When the average particle size is equal to or less than 100 nm, light resistance is good. Further, in relation to the particle size distribution of the color material, there are no particular restrictions, and the particle size distribution may be a wide particle size distribution or a monodisperse particle size distribution. Further, two or more types of color materials having a monodisperse particle size distribution may also be mixed together and used.

The average particle size and the particle size distribution of the pigment particles are found by measuring the volume average particle size by dynamic light scattering using the Nanotrac particle size distribution analyzer UPA-EX150 (manufactured by Nikkiso Co., Ltd.).

One type of pigment may be used alone or two or more types of pigments may be combined and used. From the standpoint of image density, the content of the pigment in the ink composition is preferably 1 to 25% by mass, more preferably 2 to 20% by mass, even more preferably 5 to 20% by mass, and particularly preferably 5 to 15% by mass with respect to the ink composition.

The ink composition in the present invention can contain at least one type of polymer particle. The polymer particles have the function of fixing the ink composition by destabilizing dispersion upon contact with the later-described process liquid or the region where the process liquid has been dried, causing aggregation, and increasing the viscosity of the ink The polymer particles can further improve the fixability of the ink composition to the recording medium and the abrasion resistance of the image.

In order to react with an aggregating agent, polymer particles having an anionic surface charge are used, and widely commonly known latex is used to the extent that sufficient reactivity and jetting stability are obtained, but using self-dispersing polymer particles is particularly preferred.

The ink composition in the present invention preferably contains at least one type of self-dispersing polymer particle as the polymer particles. The self-dispersing polymer particles have the function of fixing the ink composition by destabilizing dispersion upon contact with the later-described process liquid or the region where the process liquid has been dried, causing aggregation, and increasing the viscosity of the ink. The self-dispersing polymer particles can further improve the fixability of the ink composition to the recording medium and the abrasion resistance of the image. Further, the self-dispersing polymer particles are resin particles, which are preferred from the standpoint of jetting stability and the liquid stability (particularly dispersion stability) of the system including the pigment.

"Self-dispersing polymer particles" means particles of a water-insoluble polymer that does not contain a free emulsifier and which can be obtained as a dispersion in an aqueous medium due to the functional group (particularly an acid group or salt thereof) that the polymer itself has, without the presence of another surfactant.

An acid value of the self-dispersing polymer in the present invention is preferably equal to or less than 50 mg KOH/g from the standpoint of achieving good aggregability upon contact with the process liquid. Moreover, the acid value is more preferably 25 to 50 mg KOH/g and even more preferably 30 to 50 mg KOH/g. When the acid value of the self-dispersing polymer is equal to or greater than 25 mg KOH/g, the stability of self-dispersal is good.

From the standpoint of self-dispersal and aggregation speed upon contact with the process liquid, the particles of the self-dispersing polymer in the present invention preferably include a polymer having a carboxyl group, more preferably include a polymer having a carboxyl group and an acid value of 25 to 50 mg KOH/g, and even more preferably include a polymer having a carboxyl group and an acid value of 30 to 50 mg KOH/g.

As for the molecular weight of the water-insoluble polymer configuring the particles of the self-dispersing polymer, the weight average molecular weight is preferably 3,000 to 200,000, more preferably 5,000 to 150,000,and even more preferably 10,000 to 100,000. By making the weight average molecular weight equal to or greater than 3,000, the amount of the water-soluble component can be effectively suppressed. Further, by making the weight average molecular weight equal to or less than 200,000, self-dispersal stability can be enhanced.

The weight average molecular weight is measured by gel permeation chromatography (GPC). GPC is performed using the HLC-8220 GPC (made by Tosoh Corporation), using three columns of TSKgel Super HZM-H, TSKgel Super HZ4000, and TSKgel Super HZ2000 (made by Tosoh Corporation, 4.6 mm ID×15 cm), and using an eluent of THF (tetrahydrofuran). Further, as for the conditions, the sample density is 0.35/min , the flow rate is 0.35 ml/min , the sample injection amount is 10 μl, and the measurement temperature is 40° C. GPC is performed using an IR detector.

Further, a calibration curve is created from eight samples manufactured by Tosoh Corporation: "standard sample TSK standard, polystyrene", "F-40", "F-20", "F-4", "F-1", "A-5000", "A-2500", "A-1000", and "n-propyl benzene".

As for an average particle size of the particles of the self-dispersing polymer, a volume average particle size is preferably in the range of 10 nm to 400 nm, more preferably in the range of 10 to 200 nm, and even more preferably in the range of 10 to 100 nm. When the volume average particle size is equal to or greater than 10 nm, manufacturing suitability improves. When the volume average particle size is equal to or less than 1 μm, storage stability improves.

The average particle size and the particle size distribution of the particles of the self-dispersing polymer are found by measuring the volume average particle size by dynamic light scattering using the Nanotrac particle size distribution analyzer UPA-EX150 (manufactured by Nikkiso Co., Ltd.).

One type of self-dispersing polymer particle can be used alone, or two or more types of self-dispersing polymer particles can be mixed together and used. From the standpoint of aggregation speed and image luster, the content of the particles of the self-dispersing polymer in the ink composition is preferably 1 to 30% by mass and more preferably 5 to 15% by mass with respect to the ink composition.

Further, from the standpoint of the abrasion resistance of the image, the content ratio between the pigment and the particles of the self-dispersing polymer in the ink composition (e.g., water-insoluble pigment particles/particles of self-dispersing polymer) is preferably 1/0.5 to 1/10 and more preferably 1/1 to 1/4.

The ink composition in the present invention can contain at least one type of water-soluble polymerizable compound that is polymerized by an active energy ray. The polymerizable compound is preferably a non-ionic or cationic polymerizable compound in terms of not hindering the reaction between the aggregating agent, the pigment, and polymer particles. Further, "water-soluble" means that a fixed concentration or more is able to be dissolved in water, and it suffices for the polymerizable compound to be a polymerizable compound that can be dissolved (preferably uniformly) in the aqueous ink. Further, the polymerizable compound may also be a polymerizable compound whose solubility is increased by adding a water-soluble organic solvent and which dissolves (preferably uniformly) in the ink. Specifically, the solubility of the polymerizable compound with respect to water is preferably equal to or greater than 10% by mass and more preferably equal to or greater than 15% by mass.

In terms of not hindering the reaction between the aggregating agent, the pigment, and polymer particles, the polymerizable compound is preferably a non-ionic or cationic polymerizable compound and is preferably a polymerizable compound whose solubility with respect to water is equal to or greater than 10% by mass (and more preferably equal to or greater than 15% by mass).

The polymerizable compound in the present invention is preferably a polyfunctional monomer from the standpoint of being able to enhance abrasion resistance. The polymerizable compound is preferably a bifunctional to hexafunctional monomer, and a preferably a bifunctional to quadrifunctional monomer from the standpoint of achieving a balance between solubility and abrasion resistance. The ink composition can contain one type of polymerizable compound alone or can contain a combination of two or more types of polymerizable compounds.

The content of the polymerizable compound in the ink composition is preferably 30 to 300% by mass and more preferably 50 to 200% by mass with respect to the combined total solid content of the pigment and the particles of the self-dispersing polymer. When the content of the polymerizable compound is equal to or greater than 30% by mass, image strength improves more and the image has good abrasion resistance. When the content of the polymerizable compound is equal to or less than 300% by mass, this is advantageous in terms of pile height.

At least one of the ink composition and the process liquid further includes an initiator that initiates the polymerization of the polymerizable compound by an active energy ray.

The ink composition in the present invention can contain, with or without being contained in the process liquid, at least one type of initiator that initiates the polymerization of the polymerizable compound by an active energy ray. One type of photopolymerization initiator can be used alone, or two or more types of photopolymerization initiators can be mixed together and used, and the photopolymerization initiator can be used together with a sensitizer.

For the initiator, a compound that can initiate the polymerization reaction by an active energy can be appropriately selected and contained. For example, an initiator that generates an active species (radical, acid, salt, base, etc.) upon exposure to radiation or light or an electron beam (e.g., a photopolymerization initiator) can be used.

In a case where the ink composition contains an initiator, the content of the initiator in the ink composition is preferably 1 to 40% by mass and more preferably 5 to 30% by mass with respect to the polymerizable compound. When the content of the initiator is equal to or greater than 1% by mass, the abrasion resistance of the image improves more, which is advantageous for high-speed recording. When the content of the initiator is equal to or less than 40% by mass, this is advantageous in terms of jetting stability.

The ink composition in the present invention can contain at least one type of water-soluble organic solvent. The water-soluble organic solvent can obtain an anti-drying, wetting, or penetration enhancing effect. The water-soluble organic solvent is used as an anti-drying agent that prevents a situation where the ink adheres to and dries in the ink jetting ports of the jetting nozzles such that aggregates form and clog the ink jetting ports. For the anti-drying and wetting, the water-soluble organic solvent whose vapor pressure is lower than that of water is preferred. Further, the water-soluble organic solvent can be used as a penetration enhancer that enhances the penetration of the ink into the paper.

One type of anti-drying agent may be used alone, or two or more types of anti-drying agents may be used together. The content of the anti-drying agent is preferably in a range of 10 to 50% by mass in the ink composition.

The penetration enhancer is suitable for the purpose of allowing the ink composition to better penetrate the recording medium (printing paper sheets, etc.). One type of penetration enhancer may be used alone, or two or more types of penetration enhancers may be used together. The content of the penetration enhancer is preferably in a range of 5 to 30% by mass in the ink composition. Further, the penetration enhancer is preferably used in a range of an amount that does not cause image bleeding or print-through.

The ink composition contains water, but there are no particular restrictions on an amount of the water. The preferred content of water is 10 to 99% by pass, more preferably 30 to 80% by mass, and even more preferably 50 to 70% by mass.

The ink composition in the present invention can be configured using other additives in addition to the components described above. Example of other additives include publicly known additives such as anti-drying agents (wetting agents), anti-fading agents, emulsion stabilizers, penetration enhancers, UV absorbers, preservatives, antifungal agents, pH modifiers, surface tension modifiers, defoamers, viscosity modifiers, dispersants, dispersion stabilizers, corrosion inhibitors, and chelating agents.

(Process Liquid)

The process liquid includes at least an aggregating agent that causes the components in the ink composition that have already been described to aggregate, and the process liquid can be configured using other components as needed. By using the process liquid together with the ink composition, the speed of inkjet recording can be increased and an image whose density and resolution are high and has good drawability (e.g., the reproducibility of fine lines and minute sections) can be obtained even when recorded at a high speed.

The aggregating agent may be a compound that can change a pH of the ink composition, or may be a polyvalent metal salt, or may be a polyallylamine. From the standpoint of the aggregability of the ink composition, a compound that can change the pH of the ink composition is preferred, and a compound that can lower the pH of the ink composition is more preferred.

Examples of compounds that can lower the pH of the ink composition include acidic substances. Examples of suitable acidic substances include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyronecarboxylic acid, pyrrolecarboxylic acid, furancarboxylic acid, pyridinecarboxylic acid, coumalic acid, thiophenecarboxylic acid, and nicotinic acid, or derivatives of these compounds, or salts of these.

One type of acidic substance can be used alone, or two or more types of acidic substances can be used.

In a case where the process liquid in the present invention includes an acidic substance, the pH (25° C.) of the process liquid is preferably equal to or less than 6 and more preferably equal to or less than 4. The pH (25° C.) is preferably in a range of 0.5 to 4, more preferably in the range of 1 to 4, and particularly preferably in the range of 1 to 3. At this time, the pH (25° C.) of the ink composition is preferably equal to or greater than 7.5 (and more preferably equal to or greater than 8.0).

From the standpoint of image density, resolution, and increasing the speed of inkjet recording, a case where the pH (25° C.) of the ink composition is equal to or greater than 8.0 and the pH (25° C.) of the process liquid is 0.5 to 4 is preferred.

Examples of the polyvalent metal salt include salts of alkaline earth metals belonging to group 2 of the periodic table (e.g., magnesium and calcium), transition metals belonging to group 3 of the periodic table (e.g., lanthanum), cations from group 13 of the periodic table (e.g., aluminum), and lanthanides (e.g., neodymium). As salts of these metals, carboxylates (formic acid, acetic acid, benzoates, etc.), nitrates, chlorides, and thiocyanates are suitable. Preferred are calcium salts or magnesium salts of carboxylic acids (formic acid, acetic acid, benzoates, etc.), calcium salt or magnesium salt of nitric acid, calcium chloride, magnesium chloride, and calcium salts or magnesium salts of thiocyanates.

As the aggregating agent, an acidic substance whose solubility in water is high is preferred. In terms of enhancing aggregability and fixing all the ink, an organic acid is preferred, an organic acid with an acid number equal to or greater than 2 is more preferred, and an acidic substance with an acid number from 2 to 3 is particularly preferred. As the organic acid with an acid number equal to or greater than 2, an organic acid whose first pKa is equal to or less than 3.5 is preferred, and more preferred is an organic acid whose first pKa is equal to or less than 3.0. Specifically, suitable examples include phosphoric acid, oxalic acid, malonic acid, and citric acid.

One type of aggregating agent can be used alone, or two or more types of aggregating agents can be mixed together and used.

The content, in the process liquid, of the aggregating agent that causes the ink composition to aggregate is preferably in the range of 1 to 50% by mass, more preferably in the range of 3 to 45% by mass, and even more preferably in the range of 5 to 40% by mass.

The process liquid can contain other additives as other components to the extent that they do not impair the effects of the present invention. Example of other additives include publicly known additives such as anti-drying agents (wetting agents), anti-fading agents, emulsion stabilizers, penetration enhancers, UV absorbers, preservatives, antifungal agents, pH modifiers, surface tension modifiers, defoamers, viscosity modifiers, dispersants, dispersion stabilizers, corrosion inhibitors, and chelating agents.

(Paper Sheet on which Image is Formed by Aqueous UV Ink)

For the paper sheet P that serves as the recording medium, general-purpose printing paper (paper mainly consisting of cellulose, such as so-called wood-free paper, coated paper, and art paper) used in common offset printing and so forth can be used. In the present example, coated paper is used. Coated paper is commonly formed by applying a coating material to the front surface of wood-free paper or acid-free paper that has not been surface-treated to thereby dispose a coat layer on the paper. Specifically, art paper, coated paper, lightweight coated paper, and lightly coated paper can be suitably used.

Further, in the inkjet recording method of the present embodiment, it is preferred that a paper sheet where the decay rate of ultrasonic transmittance after 5 seconds with respect to ultrasonic transmittance immediately after immersion in pure water (hereinafter sometimes called "ultrasonic decay rate") is from 4% to 26% be used for the paper sheet P. Here, "decay rate (ultrasonic decay rate)" means the decay rate (%) of ultrasonic transmittance at the point in time when 5 seconds has elapsed when 100 represents ultrasonic transmittance immediately after immersion (0 seconds) of the paper sheet in pure water.

Specifically, the EST-12 Sizing Tester (made by emtec Electric GMbH) is used to measure, over time, ultrasonic transmittance after test paper has been immersed in pure water and to calculate the ultrasonic decay rate 5 seconds after immersion (the decay rate at the point in time when 5 seconds has elapsed when 100 represents ultrasonic transmittance immediately after immersion (0 seconds)). This utilizes the principle that gas bubbles in the paper disappear and ultrasonic transmittance decays as the pure water penetrates the paper, and the ultrasonic transmittance decay highly correlates with penetration speed in the paper. That is, in a case where the ultrasonic decay rate (%) is high, the penetration speed is fast, and in a case where the ultrasonic decay rate (%) is low, the penetration speed is slow. The ultrasonic decay rate of the paper sheet P is preferably from 4% to 26%, more preferably from 4% to 15%, and even more preferably from 7% to 15%.

(Details of Inkjet Recording Method of Present Embodiment)

Next, an inkjet recording method using the inkjet recording apparatus 10 (mainly from the jetting step resulting from the image recording section 18 to the exposure step resulting from the UV irradiation treatment section 22) will be described in greater detail.

As shown in FIG. 1, in the image recording section 18, liquid droplets of ink (aqueous UV ink) of the corresponding colors are jetted from the inkjet heads 56C, 56M, 56Y, and 56K toward the recording surface of the paper sheet P that is in close contact with and held on the image recording drum 52, whereby the ink contacts the process liquid that has been applied beforehand to the recording surface by the process liquid application section 14, the color material (pigment) dispersed in the ink is aggregated, and a color material aggregate is formed. Because of this, color material flow on the paper sheet P is prevented and an image is formed on the recording surface of the paper sheet P.

The liquid droplet quantity of the ink jetted from the inkjet heads 56C, 56M, 56Y, and 56K is preferably 1 to 10 pl (picoliters) and more preferably 1.5 to 6 pl from the standpoint of obtaining a high-definition image. Further, combining and jetting different liquid droplet quantities is also effective from the standpoint of improving image uniformity and continuous tone, and the present invention is suitably applied in this case also.

In the present example, the CMYK standard color (four-color) configuration is exemplified, but the combination of ink colors and the number of colors are not limited to those in the present embodiment. Light inks, dark inks, and special color inks may also be added as needed. For example, a configuration that adds inkjet heads that jet light inks such as light cyan and light magenta is also possible, and the order in which the color heads are placed is also not particularly limited.

As shown in FIG. 2, in the ink drying treatment section 20, the ink drying treatment units 68 administer the drying treatment to the paper sheet P conveyed by the chain gripper 64. That is, the ink drying treatment section 20 has a configuration that dries the water included in the solvent that has been separated out by the color material aggregating action, and the ink drying treatment units 68, in which plural combinations of IR heaters or the like and fans are placed, are disposed in positions opposing the paper sheet P conveyed by the chain gripper 64.

The chain gripper 64 grips the leading end of the paper sheet P with the gripper 64D and conveys the paper sheet P along the planar guide plate 72. The drying treatment is administered by the ink drying treatment units 68 disposed inside the chain gripper 64. As a result, the drying treatment is administered to the paper sheet P by hot air from the ink drying treatment units 68 while back tension is applied to the paper sheet P by the back tension application mechanism 66. Because of this, it becomes possible to suppress curling and cockling of the paper sheet P.

The hot air blasting nozzles of the ink drying treatment units 68 are configured to blow the hot air, which is controlled to a predetermined temperature, at a fixed air volume toward the paper sheet P, and the IR heaters are controlled to a predetermined temperature. The water included in the recording surface of the paper sheet P is evaporated by these hot air blasting nozzles and IR heaters, whereby the drying treatment is performed. The hot air volume and the temperature resulting from the ink drying treatment units 68 are controlled by an unillustated control device disposed in the inkjet recording apparatus 10.

The evaporated water is preferably exhausted to the outside of the apparatus together with the air by unillustrated exhausting means. Further, the air may also be cooled by a cooler (radiator) and discharged as a liquid.

The UV irradiation treatment section 22 fixes the image by applying ultraviolet (UV) light from the UV irradiation units 74 to the image that has been recorded using the aqueous UV ink on the recording surface of the paper sheet P. The UV irradiation units 74 may use plural ultraviolet light sources. Because of this, it becomes possible to satisfy the curing conditions in the irradiation time while reducing the irradiation intensity of each of the ultraviolet light sources, and a reduction in cost and a reduction in the amount of heat given off by the UV irradiation units 74 can be achieved.

In the inkjet recording method of the present embodiment, it is preferred that the paper sheet be conveyed to the UV irradiation treatment section 22 in such a way that the amount of time from the jetting step resulting from the image recording section 18 until exposing the aqueous ultraviolet-curable ink on the paper sheet to ultraviolet light with the UV irradiation treatment section 22 is from 1 second to 8 seconds. Particularly, a period from the point in time when the aqueous ultraviolet-curable ink has been jetted onto the paper sheet until the paper sheet is exposed to the ultraviolet light. More specifically, this amount of time is preferably from 1 second to 8 seconds, more preferably from 1 second to 6 seconds, and even more preferably from 2 seconds to 6 seconds. When the amount of time is shorter than 1 second, the residual amount of the monomer in the aqueous UV ink on the upper surface of the paper sheet increases and there is the potential for the degree of close adhesion to the front surface of the paper sheet to drop. Further, when the amount of time is longer than 8 seconds, the water in the aqueous UV ink penetrating the paper sheet increases, whereby swelling of the paper sheet advances and there is the potential for curling to become easier to occur. The amount of time from the jetting step resulting from the image recording section 18 (the point in time when the aqueous ultraviolet-curable ink has been jetted onto the paper sheet) until exposing the aqueous ultraviolet-curable ink on the paper sheet to ultraviolet light with the UV irradiation treatment section 22 is controlled, for example, depending on the distance from the image recording section 18 to the UV irradiation treatment section 22 and the speed at which the paper sheet P is conveyed by the chain gripper 64.

The ultraviolet light sources used in the UV irradiation units 74 are not particularly limited. For example, it is possible to apply metal halide lamps, mercury lamps, excimer lasers, ultraviolet lasers, black lights, cold-cathode tubes, LEDs, and laser diodes. Metal halide lamp tubes, mercury lamp tubes, or black lights are suitably used. More preferably, light-emitting diodes that emit ultraviolet light with an emission wavelength peak of 350 to 420 nm are suitably used.

The peak wavelength of the ultraviolet light applied by the UV irradiation units 74 is preferably 200 to 600 nm, more preferably 300 to 450 nm, and even more preferably 350 to 450 nm.

Here, preferred exposure conditions resulting from the UV irradiation units 74 will be described.

Figure 5:
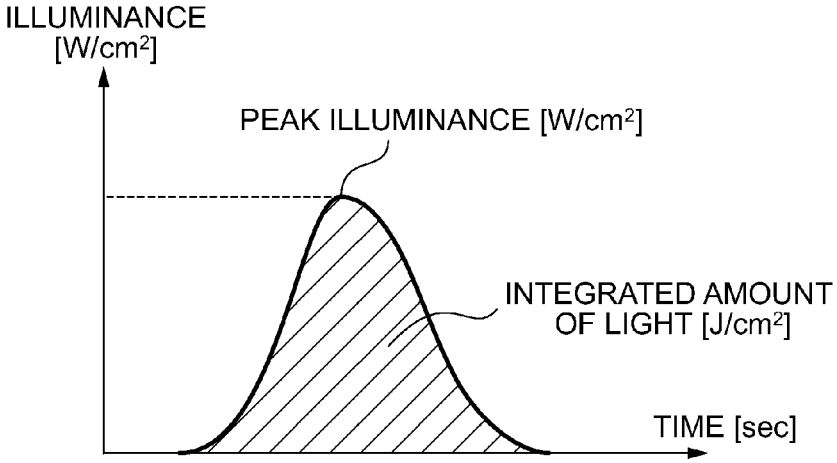
FIG. 5 is a diagram showing an integrated amount of light and peak illuminance resulting from the UV lamp.

As shown in FIG. 5, the peak illuminance, on the recording surface of the paper sheet P, of the ultraviolet light applied by the UV irradiation units 74 is preferably from 0.5 W/cm$^2$ to 8.0 W/cm$^2$, even more preferably from 1.0 W/cm$^2$ to 6.0 W/cm$^2$, and most preferably from 2.0 W/cm$^2$ to 4.0 W/cm$^2$. When the peak illuminance is less than 0.5 W/cm$^2$ (when the peak illuminance is too low), there is the potential for the polymerization reaction to be insufficient. Further, when the peak illuminance is higher than 8.0 W/cm$^2$ (when the peak illuminance is too high), the effect of the heat on the paper sheet becomes greater. The peak illuminance and a method of measuring it will be described later.

As shown in FIG. 5, the integrated amount of light, on the recording surface of the paper sheet P, of the ultraviolet light applied by the UV irradiation units 74 is preferably from 0.1 J/cm$^2$ to 1.0 J/cm$^2$, even more preferably from 0.2 J/cm$^2$ to 0.8 J/cm$^2$, and most preferably from 0.3 J/cm$^2$ to 0.7 J/cm$^2$. When the integrated amount of light is less than 0.1 J/cm$^2$ (when the integrated amount of light is too low), there is the potential for the polymerization reaction to be insufficient. Further, when the integrated amount of light is higher than 1.0 J/cm$^2$ (when the integrated amount of light is too high), the effect of heat on the paper sheet becomes greater. The integrated amount of light and a method of measuring it will be described later.

Further, in the inkjet recording apparatus 10 of the present invention, it is appropriate that the ultraviolet light be applied to the recording surface of the paper sheet P preferably for 0.01 to 10 seconds and more preferably for 0.1 to 2 seconds.

(Experimental Method for Evaluating Paper Curling and Fixability)

Figure 3:
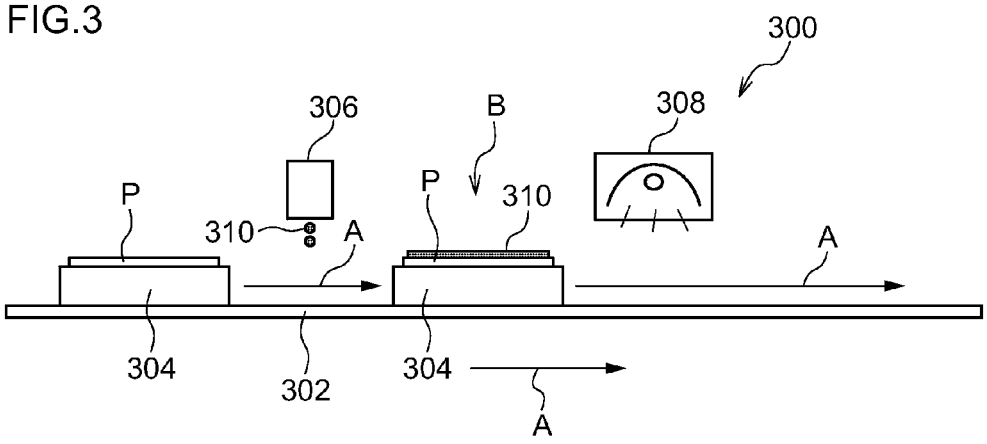
FIG. 3 is a configuration diagram showing an experimental apparatus for evaluating the inkjet recording method pertaining to the embodiment of the present invention.

In FIG. 3, there is shown an experimental apparatus 300 for evaluating paper curling and fixability.

As shown in FIG. 3, the experimental apparatus 300 is equipped with a conveyance member 302 that is moved in a fixed direction (the direction of arrow A) by unillustrated driving means, a stage 304 that is attached on top of the conveyance member 302 and conveys the paper sheet P held on an upper surface of the stage 304, an inkjet head 306 that is disposed in a position opposing the conveyance member 302, and a UV lamp 308 that is disposed in a position opposing the conveyance member 302 and is placed on the downstream side of the inkjet head 306 in the conveyance direction of the paper sheet P.

In this experimental apparatus 300, the paper sheet P on the upper surface of the stage 304 is conveyed in the direction of arrow A by the movement of the conveyance member 302, and a predetermined amount of aqueous UV ink 310 is jetted (ejected) onto the paper sheet P from the inkjet head 306 (jetting step). Then, the conveyance member 302 stops for a predetermined amount of time in a position B between the inkjet head 306 and the UV lamp 308. Thereafter, the paper sheet P on the upper surface of the stage 304 is conveyed in the direction of arrow A by the movement of the conveyance member 302 and is irradiated with ultraviolet light by the UV lamp 308, whereby the aqueous UV ink 310 on the paper sheet P is cured (exposure step).

Further, the speed at which the stage 304 is conveyed by the conveyance member 302 is set to a linear speed of 500 mm/sec (at the time of image drawing).

A metal halide lamp made by Eye Graphics Co., Ltd. is used as the UV lamp 308. The output of one lamp is set to 160 W/cm, and the distance between the UV lamp and the paper sheet is set to 80 mm.

Further, as shown in FIG. 8, six brands of the paper sheets P are used (the six brands in FIG. 8 are all trade names), and the grammage of all the paper sheets P is 104.7 g/m$^2$. Further, as for the ejection of the aqueous ink 310, the resolution is 1200 dpi and the liquid droplets are uniformly ejected (to form a solid image) at 5 pL (picoliters).

(UV Exposure Conditions, and Peak Illuminance and Integrated Amount of Light of UV Light)

Here, a method of measuring the peak illuminance and the integrated amount of light of the UV light of the UV lamp 308 will be described.

Figure 4:
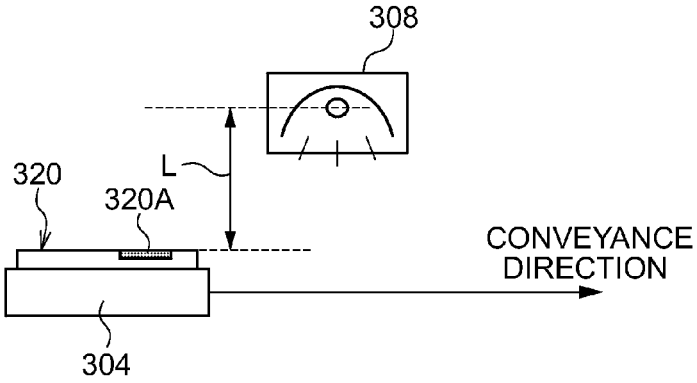
FIG. 4 is a diagram showing the positional relationship between a UV lamp and a light-receiving surface of a measuring instrument according to the experimental apparatus.

As shown in FIG. 4, in the experimental device 300 shown in FIG. 3, a measuring instrument 320 is held on top of the stage 304 and conveyed. The height of the UV lamp 308 is adjusted in such a way that a distance (irradiation distance) L from the lamp center portion of the UV lamp 308 to a light-receiving surface 320A of the measuring instrument 320 on top of the stage 304 becomes identical to the irradiation distance at the time of exposure of the paper sheet P in the UV irradiation units 74 shown in FIG. 1. The peak illuminance (W/cm$^2$) and the integrated amount of light (J/cm$^2$) are measured as a result of the UV light applied by the UV lamp 308 being received by the light-receiving surface 320A of the measuring instrument (see FIG. 5). The conditions at the time of the experiment are such that the peak illuminance is 3.0 W/cm$^2$ and the integrated amount of light is 0.5 J/cm$^2$.

As for the peak illuminance and the integrated amount of light of the UV light, the UV Power MAP made by Fusion UV Systems Japan KK is used, a measurement of the four wavelength bands of UVC (250 to 260 nm), UVB (280 to 320 nm), UVA (320 to 390 nm), and UVV (395 to 445 nm) is performed, and the sum of the measured values of the four wavelength bands is used. The values of the peak illuminance and the integrated amount of light are calculated automatically by the measuring instrument 320 shown in FIG. 4.

Here, in order to raise measurement precision, the conveyance speed is measured as 50 mm/s (1/10 that at the time of drawing), and in relation to the value of the integrated amount of light, 1/10 of the measured value is regarded as the exposure condition at the time of ejection.

(Method of Evaluating Curling of Paper Sheet)

The paper sheet on which the solid image has been printed is cut out in the shape of a 50 mm×5 mm rectangular strip (with the direction along the fibers of the paper being a direction orthogonal to the lengthwise direction), the paper sheet is left for 3 hours in an environment with a temperature of 23° C. and a relative humidity of 50%, the radius of curvature R (mm) of the paper sheet in that state is measured, and the curl value is calculated as C=1/R. The radius of curvature R is measured by using a gauge (not shown in the drawings) on which plural radii of curvature are indicated and selecting from the gauge the radius of curvature that matches the state of curvature when the length direction end portions of the paper sheet P are gripped. The evaluation of curling is determined as follows.

Good: C<10 (No curling; good)

Fair: 20>C≥10 (Curling occurs a little but at a practical level)

Poor: C≥20 (Curling is strong; not good)

(Method of Evaluating Adhesion)

Cellophane tape (made by Nichiban Co., Ltd.) cut to about 10 mm×30 mm is adhered, without trapping air, to the image surface of a solid image that had been conditioned for one day in a standard environment (23° C. and 50% RH) after printing on the paper sheet P, and the cellophane tape is slowly peeled away vertically upward over a period of about 3 seconds. The change in the shape of the surface from which the cellophane tape was peeled off and the transfer of color to the cellophane tape are visually observed, and the following determinations are made.

Good: No detachment, or detachment within layer of paper

Fair: Color transferred to tape, but no change in ink surface

Poor: Change in ink surface or detachment between ink layer and paper (Method of Evaluating Speed of Vibration in Paper (Ultrasonic Decay Rate Method))

The EST-12 Sizing Tester (made by emtec Electric GMbH) is used to measure, over time, ultrasonic transmittance after the paper sheet has been immersed in pure water and to calculate the ultrasonic decay rate 5 seconds after immersion (the decay rate at the point in time when 5 seconds has elapsed when 100 represents ultrasonic transmittance immediate after immersion (0 seconds)). This utilizes the principle that gas bubbles in the paper disappear and ultrasonic transmittance decays as the pure water penetrates the paper, and the ultrasonic transmittance decay highly correlates with penetration speed in the paper.

Figure 6:
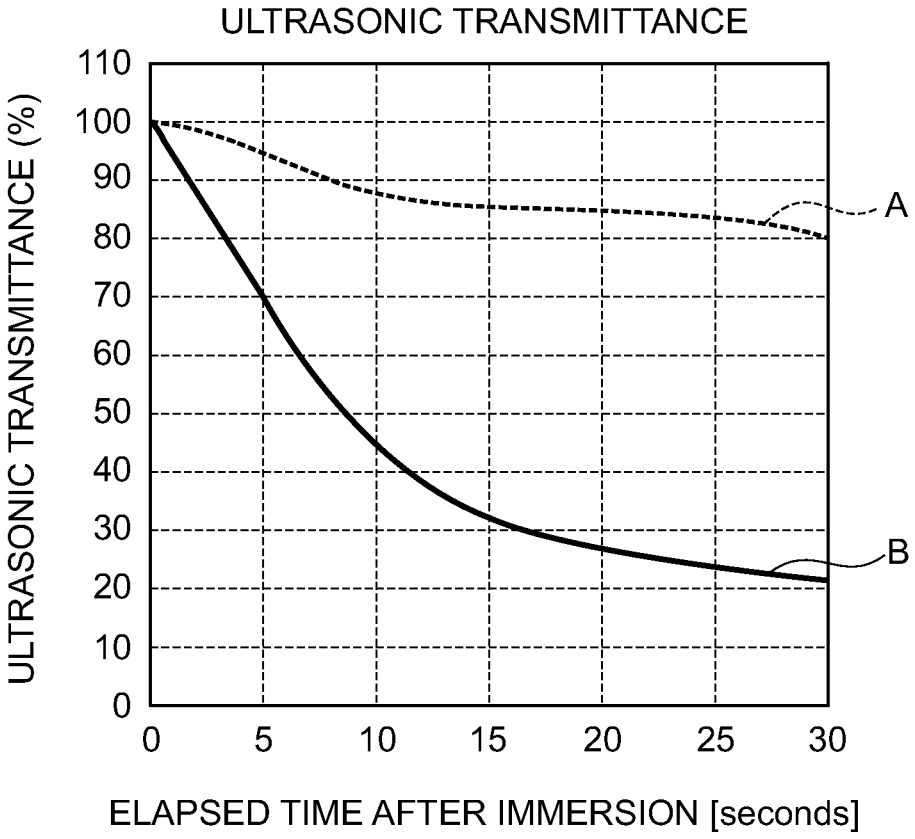
FIG. 6 is a graph showing the relationship between ultrasonic transmittance and elapsed time after immersion of the paper sheet in pure water.

In FIG. 6, as an example of measurement results, the relationship between the amount of elapsed time (in seconds) after immersion and ultrasonic transmittance (%) in a paper sheet A and a paper sheet B is shown in a graph.

As shown in FIG. 6, the ultrasonic decay rate of the paper sheet A 5 seconds after immersion in pure water is 5.0%, and the penetration of the pure water into the paper sheet A is slower compared to the paper sheet B. The ultrasonic decay rate of the paper sheet B 5 seconds after immersion in pure water is 30.0%, and the penetration of the pure water into the paper sheet B is faster compared to the paper sheet A.

Figure 7:
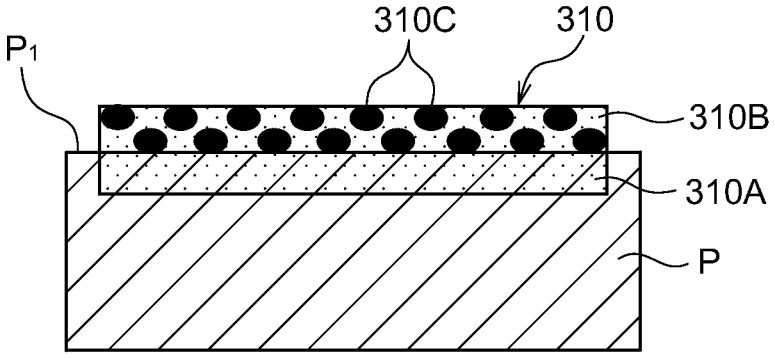
FIG. 7 is a schematic configuration diagram showing the state of aqueous ultraviolet-curable ink that has been jetted onto a front surface of the paper sheet.

In FIG. 7, the state of penetration of the aqueous UV ink 310 when the aqueous UV ink 310 has been jetted onto the paper sheet P is shown in a schematic configuration diagram.

As shown in FIG. 7, the aqueous UV ink that has been jetted onto the paper sheet P has an internal penetration section 310A in which the water and the UV-curable monomer penetrate into the inside of the paper sheet P, a front surface residual section 310B in which the water and the UV-curable monomer remain above a front surface $P_1$ of the paper sheet P, and colored pigment 310C that is included in the front surface residual section 310B. For example, in the paper sheet P in which the penetration speed is fast (the ultrasonic decay rate is high), the internal penetration section 310A becomes greater.

FIG. 8 shows curling and fixability evaluation results which were obtained according to the aforementioned methods in this experiment. In each of the evaluation results, left side indication represents evaluation of curling of the printed paper and right side indication represents evaluation of fixability of recorded image to the paper.

As shown in FIG. 8, there is a tendency for curling to become worse the faster the penetration speed is (the higher the ultrasonic decay rate is) and the longer the amount of time from the jetting (drawing) of the aqueous UV ink 310 to the UV irradiation is. The causes for this are presumed to be the fact that the amount of water that has been penetrated the paper sheet P increases and the fact that the swelling of the paper sheet P advances as the amount of time until the water is volatized by the heat from the UV lamp 308 increases.

Further, there is a tendency for adhesion to become worse the slower the penetration speed is (the lower the ultrasonic decay rate is) and the shorter the amount of time from the jetting (drawing) of the aqueous UV ink 310 to the UV irradiation is. This is presumed to be because the residual amount of the UV-curable ink on the upper surface of the paper sheet increases and the degree of adhesion to the front surface of the paper sheet P decreases. Worsening of adhesion due to the curable monomer excessively penetrating the paper sheet was not confirmed in the present experiment.

From the evaluation results shown in FIG. 8, it was confirmed that by using a paper sheet where the decay rate of ultrasonic transmittance (ultrasonic decay rate) after 5 seconds with respect to ultrasonic transmittance immediately after immersion of the paper sheet in pure water is from 4% to 26% and setting the amount of time from the jetting (drawing) of the aqueous UV ink until the UV irradiation in such a way that it is from 1 second to 8 seconds, the occurrence of curling of the paper sheet P is suppressed and adhesion of the image on the paper sheet P is good.

According to these evaluation results, the ultrasonic decay rate of the paper sheet P is preferably from 4% to 26%, more preferably from 4% to 15%, and even more preferably from 7% to 15%. Further, the amount of time from the jetting (drawing) of the aqueous UV ink until the UV irradiation is preferably from 1 second to 8 seconds, more preferably from 1 second to 6 seconds, and even more preferably from 2 seconds to 6 seconds.

Further, in the inkjet recording apparatus 10 shown in FIG. 1, in a case where the process liquid application section 14 applies the process liquid to the front surface of the paper sheet P, it is preferred that the paper sheet be adjusted in such a way that the ultrasonic decay rate of the paper sheet after the process liquid has been applied and dried is from 4% to 26%. Because of this, the occurrence of curling of the paper sheet P is suppressed and adhesion of the image on the paper sheet P is good.

Here, preferred exposure conditions resulting from the UV irradiation units 74 will be described.

As shown in FIG. 5, the peak illuminance, on the recording surface of the paper sheet P, of the ultraviolet light applied by the UV irradiation units 74 is preferably from 0.5 W/cm$^2$ to 8.0 W/cm$^2$, even more preferably from 1.0 W/cm$^2$ to 6.0 W/cm$^2$, and most preferably from 2.0 W/cm$^2$ to 4.0 W/cm$^2$. When the peak illuminance is less than 0.5 W/cm$^2$ (when the peak illuminance is too low), there is the potential for the polymerization reaction to be insufficient. Further, when the peak illuminance is higher than 8.0 W/cm$^2$ (when the peak illuminance is too high), the effect of heat on the paper sheet becomes greater.

As shown in FIG. 5, the integrated amount of light, on the recording surface of the paper sheet P, of the ultraviolet light applied by the UV irradiation units 74 is preferably from 0.1 J/cm$^2$ to 1.0 J/cm$^2$, even more preferably from 0.2 J/cm$^2$ to 0.8 J/cm$^2$, and most preferably from 0.3 J/cm$^2$ to 0.7 J/cm$^2$. When the integrated amount of light is less than 0.1 J/cm$^2$ (when the integrated amount of light is too low), there is the potential for the polymerization reaction to be insufficient. Further, when the integrated amount of light is higher than 1.0 J/cm$^2$ (when the integrated amount of light is too high), the effect of heat on the paper sheet becomes greater.

In the above-described experiment, the grammage of all the paper sheets P is set to 104.7 g/m$^2$, but the grammage of the paper sheet P is not limited to this. In a case where the grammage of the paper sheet P is greater than 104.7 g/m$^2$ (in a case where the paper sheet is thick), it becomes more difficult for curling of the paper sheet to occur. In a case where the grammage of the paper sheet P is smaller than 104.7 g/m$^2$ (in a case where the paper sheet is thin), it generally becomes easier for curling of the paper sheet to occur, but in the present embodiment, by using a paper sheet where the decay rate of ultrasonic transmittance (ultrasonic decay rate) after 5 seconds with respect to ultrasonic transmittance immediately after immersion of the paper sheet in pure water is from 4% to 26% and setting the amount of time from the jetting (drawing) of the aqueous UV ink until the UV irradiation in such a way that it is from 1 second to 8 seconds, the occurrence of curling of the paper sheet P can be suppressed.

Further, because UV irradiation is performed while the back tension application mechanism 66 sucks the paper sheet P and applies back tension to the paper sheet P, the occurrence of curling of the paper sheet can be suppressed more effectively.

Moreover, by using the ink drying treatment unit 68 to dry, between the jetting step and the exposure step, the paper sheet onto which the aqueous UV ink has been jetted, swelling of the water and UV-curable monomer in the aqueous UV ink into the paper sheet can be suppressed, and the occurrence of curling can be suppressed more effectively.

(Other)

An embodiment of the present invention has been described above, but the present invention is in no way limited to the above embodiment and, it goes without saying, can be implemented in a variety of ways without departing from the gist of the present invention.

In the inkjet recording apparatus 10, the aqueous UV ink on the paper sheet P is cured by the UV irradiation units 74 while the paper sheet P is conveyed by the chain gripper 64, but the inkjet recording apparatus 10 is not limited to this and may also be given a configuration where the aqueous UV ink on the paper sheet P is cured by the UV irradiation units 74 placed in opposition to a drum (an impression cylinder) while the paper sheet P is conveyed by the drum (impression cylinder).

What is claimed is:

1. An inkjet recording method comprising:

a jetting step using a paper sheet, wherein a decay rate of ultrasonic transmittance through the paper sheet after five seconds with respect to ultrasonic transmittance through the paper sheet immediately after immersion of the paper sheet in pure water is from 4% to 26%, and jetting aqueous ultraviolet-curable ink onto a front surface of the paper sheet with an inkjet recording head;

a conveyance step of conveying the paper sheet to an exposure section such that an amount of time from the jetting step until exposing the aqueous ultraviolet-curable ink on the paper sheet to ultraviolet light is from 1 second to 8 seconds; and an exposure step of exposing the aqueous ultraviolet-curable ink on the paper sheet to ultraviolet light to thereby cure the aqueous ultraviolet-curable ink.

2. The inkjet recording method according to claim 1, further comprising, before the jetting step, a process liquid application step of applying a process liquid to the front surface of the paper sheet and drying the process liquid, wherein the paper sheet is adjusted such that the decay rate of the paper sheet after the process liquid application step is from 4% to 26%.

3. The inkjet recording method according to claim 1, wherein the aqueous ultraviolet-curable ink on the paper sheet is exposed to ultraviolet light by the exposure step in a state in which the paper sheet is conveyed while the paper sheet is sucked onto a conveyance surface and tension is applied to the paper sheet.

4. The inkjet recording method according to claim 1, wherein in the exposure step, a peak illuminance on the front surface of the paper sheet resulting from an exposure lamp is set in a range from 0.5 W/cm$^2$ to 8.0 W/cm$^2$.

5. The inkjet recording method according to claim 1, wherein in the exposure step, an integrated amount of light on the front surface of the paper sheet resulting from an exposure lamp is set in a range from 0.1 J/cm$^2$ to 1.0 J/cm$^2$.

6. The inkjet recording method according to claim 1, further comprising, between the jetting step and the exposure step, a drying step of drying the paper sheet onto which the aqueous ultraviolet-curable ink has been jetted.

7. The inkjet recording method according to claim 1, wherein the aqueous ultraviolet-curable ink includes at least a color material, a polymerizable monomer that is polymerized by ultraviolet light, an initiator that initiates the polymerization of the polymerizable monomer by ultraviolet light, and 50% by mass or more of water.

* * * * *